US010847166B2

(12) United States Patent
Fuchs et al.

(10) Patent No.: US 10,847,166 B2
(45) **Date of Patent: *Nov. 24, 2020**

(54) CODING OF SPECTRAL COEFFICIENTS OF A SPECTRUM OF AN AUDIO SIGNAL

(71) Applicant: Fraunhofer-Gesellschaft zur Foerderung der angewandten Forschung e.V., Munich (DE)

(72) Inventors: Guillaume Fuchs, Erlangen (DE); Matthias Neusinger, Rohr (DE); Markus Multrus, Nuremberg (DE); Stefan Doehla, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/156,641

(22) Filed: Oct. 10, 2018

(65) Prior Publication Data

US 2019/0043513 A1 Feb. 7, 2019

Related U.S. Application Data

(63) Continuation of application No. 15/860,311, filed on Jan. 2, 2018, now Pat. No. 10,115,401, which is a (Continued)

(30) Foreign Application Priority Data

Oct. 18, 2013 (EP) ..... 13189391
Jul. 28, 2014 (EP) ..... 14178806

(51) Int. Cl.
*G10L 19/00* (2013.01)
*G10L 19/032* (2013.01)
*G10L 19/02* (2013.01)

(52) U.S. Cl.
CPC ..... *G10L 19/0017* (2013.01); *G10L 19/032* (2013.01); *G10L 19/02* (2013.01)

(58) Field of Classification Search
CPC ..... G10L 19/0017; G10L 19/02
See application file for complete search history.

(56) References Cited

U.S. PATENT DOCUMENTS 5,583,500 A 12/1996 Schwartz et al.
7,110,941 B2 * 9/2006 Li ..... G10L 19/02 704/200.1

(Continued)

FOREIGN PATENT DOCUMENTS

CN 101223573 A 7/2008
CN 101484938 A 7/2009

(Continued)

OTHER PUBLICATIONS

Chen, Juin-Hwey et al., "Transform predictive coding of wideband speech signals", Acoustics, Speech, and Signal Processing, 1996. ICASSP-96. Conference Proceedings., 1996 IEEE International Conference on, vol. 1, No. May 7, 1996, pp. 275-278 vol. 1.

(Continued)

*Primary Examiner* — Samuel G Neway
(74) *Attorney, Agent, or Firm* — Perkins Coie LLP; Michael A. Glenn

(57) ABSTRACT

A coding efficiency of coding spectral coefficients of a spectrum of an audio signal is increased by en/decoding a currently to be en/decoded spectral coefficient by entropy en/decoding and, in doing so, performing the entropy en/decoding depending, in a context-adaptive manner, on a previously en/decoded spectral coefficient, while adjusting a relative spectral distance between the previously en/decoded spectral coefficient and the currently en/decoded spectral coefficient depending on an information concerning a shape of the spectrum. The information concerning the shape of (Continued)

the spectrum may have a measure of a pitch or periodicity of the audio signal, a measure of an inter-harmonic distance of the audio signal's spectrum and/or relative locations of formants and/or valleys of a spectral envelope of the spectrum, and on the basis of this knowledge, the spectral neighborhood which is exploited in order to form the context of the currently to be en/decoded spectral coefficients may be adapted to the thus determined shape of the spectrum, thereby enhancing the entropy coding efficiency.

19 Claims, 18 Drawing Sheets

Related U.S. Application Data continuation of application No. 15/130,589, filed on Apr. 15, 2016, now Pat. No. 9,892,735, which is a continuation of application No. PCT/EP2014/072290, filed on Oct. 17, 2014.

(56) References Cited

U.S. PATENT DOCUMENTS

| | | | | |
|---|---|---|---|---|
| 8,090,574 | B2 * | 1/2012 | Mehrotra | G10L 19/032 341/56 |
| 9,892,735 | B2 * | 2/2018 | Fuchs | G10L 19/0017 |
| 10,115,401 | B2 * | 10/2018 | Fuchs | G10L 19/0017 |
| 2007/0016418 | A1 | 1/2007 | Mehrotra et al. | |
| 2009/0234644 | A1 | 9/2009 | Reznik et al. | |
| 2010/0070284 | A1 | 3/2010 | Oh et al. | |
| 2010/0232621 | A1 | 9/2010 | Aichner et al. | |
| 2011/0161088 | A1 | 6/2011 | Bayer et al. | |
| 2011/0238426 | A1 * | 9/2011 | Fuchs | G10L 19/028 704/500 |
| 2012/0245947 | A1 | 9/2012 | Neuendorf et al. | |
| 2013/0117015 | A1 * | 5/2013 | Bayer | G10L 19/022 704/207 |
| 2014/0156284 | A1 | 6/2014 | Porov et al. | |
| 2016/0307576 | A1 * | 10/2016 | Fuchs | G10L 19/0017 |
| 2018/0122387 | A1 * | 5/2018 | Fuchs | G10L 19/0017 |
| 2019/0043513 | A1 * | 2/2019 | Fuchs | G10L 19/0017 |

FOREIGN PATENT DOCUMENTS

| | | | |
|---|---|---|---|
| CN | 102177543 | A | 9/2011 |
| CN | 102648494 | A | 8/2012 |
| CN | 102884572 | A | 1/2013 |
| CN | 103329199 | A | 9/2013 |
| EP | 2110808 | B1 | 10/2009 |
| EP | 2650878 | | 10/2013 |
| JP | 2007108440 | A | 4/2007 |
| JP | 2013521540 | A | 6/2013 |
| RU | 2455709 | C2 | 7/2012 |
| RU | 2459282 | C2 | 8/2012 |
| RU | 2464649 | C1 | 10/2012 |
| RU | 2486484 | C2 | 6/2013 |
| WO | 1997015983 | A1 | 5/1997 |
| WO | 2010003581 | A1 | 1/2010 |
| WO | 2012102149 | A1 | 8/2012 |
| WO | 2014001182 | | 4/2015 |

OTHER PUBLICATIONS

Fuchs, Guillaume et al., "Efficient context adaptive entropy coding for real-time applications", Acoustics, Speech and Signal Processing (ICASSP), 2011 IEEE International Conference on, vol., No., May 22, 2011, pp. 493-496.

ISO/IEC 13818, "ISO/IEC 13818, Part 7 MPEG-2AAC", Aug. 2003, 198 pages.

Neundorf, Max et al., "MPEG Unified Speech and Audio Coding—The ISO/MPEG Standard for High Efficiency Audio Coding of All Content Types", AES Convention 132; Apr. 2012, AES, 60 East 42nd Street, Room 2520 New York 10165-2520, USA, Apr. 26, 2012, pp. 3, 4, 7.

* cited by examiner

CONVENTIONAL CONTEXT COVERING THE NEIGHBORHOOD

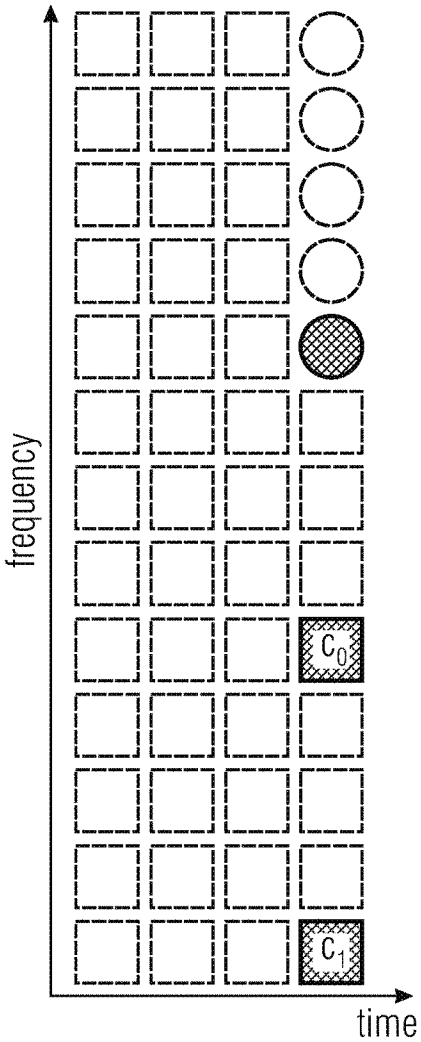
Fig. 16c
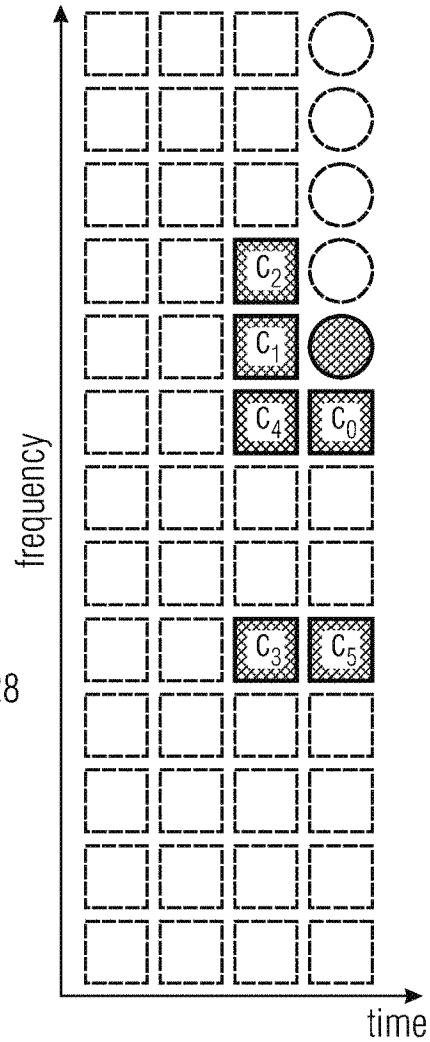
Fig. 16b
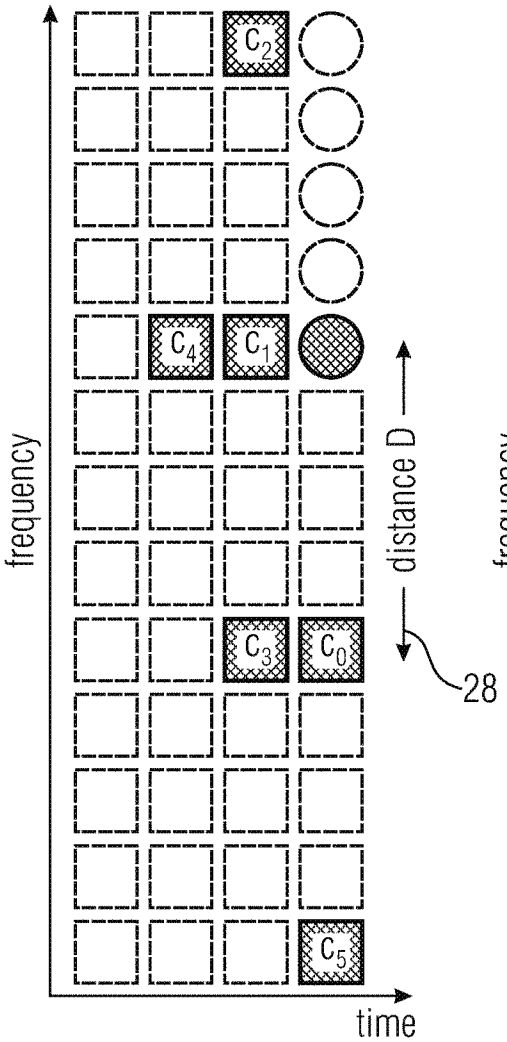
Fig. 16a
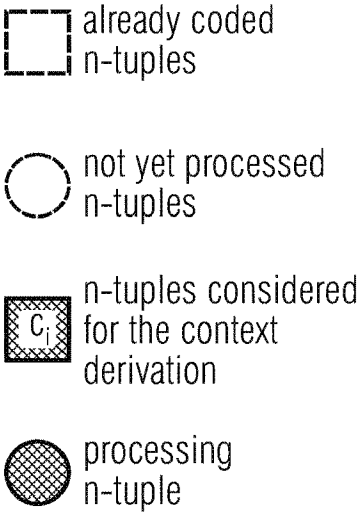

SEARCH ALGORITHM FOR THE OPTIMAL DISTANCE D FOR THE CONTEXT MAPPING

CODING OF SPECTRAL COEFFICIENTS OF A SPECTRUM OF AN AUDIO SIGNAL

CROSS-REFERENCE TO RELATED APPLICATIONS

This application is a continuation of U.S. patent application Ser. No. 15/860,311 filed Jan. 2, 2018, which is a continuation of U.S. patent application Ser. No. 15/130,589 filed Apr. 15, 2016, which is a continuation of copending International Application No. PCT/EP2014/072290, filed Oct. 17, 2014, which are incorporated herein by reference in entirety, and additionally claims priority from European Application No. 13189391.9, filed Oct. 18, 2013, and from European Application No. 14178806.7, filed Jul. 28, 2014, which are also incorporated herein by reference in their entirety.

BACKGROUND OF THE INVENTION

The present application is concerned with a coding scheme for spectral coefficients of a spectrum of an audio signal usable in, for example, various transform-based audio codecs.

The context-based arithmetic coding is an efficient way of noiselessly encoding the spectral coefficients of a transform-based coder [1]. The context exploits the mutual information between a spectral coefficient and the already coded coefficients lying in its neighborhood. The context is available at both the encoder and decoder side and doesn't need any extra information to be transmitted. In this way, context-based entropy coding has the potential to provide higher gain over memoryless entropy coding. However in practice, the design of the context is seriously constrained due to amongst of others, the memory requirements, the computational complexity and the robustness to channel errors. These constrains limit the efficiency of the context-based entropy coding and engender a lower coding gain especially for tonal signals where the context has to be too limited for exploiting the harmonic structure of the signal.

Moreover, in low delay audio transformed-based coding, low-overlap windows are used to decrease the algorithmic delay. As a direct consequence, the leakage in the MDCT is important for tonal signals and results in a higher quantization noise. The tonal signals can be handled by combining the transform with prediction in frequency domain as it is done for MPEG2/4-AAC [2] or with a prediction in time-domain [3].

It would be favorable to have a coding concept at hand which increases the coding efficiency.

SUMMARY

An embodiment may have a decoder configured to decode spectral coefficients of a spectrum of an audio signal, the spectral coefficients belonging to the same time instant, the decoder being configured to sequentially, from low to high frequency, decode the spectral coefficients and decode a currently to be decoded spectral coefficient of the spectral coefficients by entropy decoding depending, in a context-adaptive manner, on a previously decoded spectral coefficient of the spectral coefficients, with adjusting a relative spectral distance between the previously decoded spectral coefficient and the currently to be decoded spectral coefficient depending on an information concerning a shape of the spectrum.

Another embodiment may have a transform-based audio decoder having a decoder configured to decode spectral coefficients of a spectrum of an audio signal as mentioned above Another embodiment may have an encoder configured to encode spectral coefficients of a spectrum of an audio signal, the spectral coefficients belonging to the same time instant, the encoder being configured to sequentially, from low to high frequency, encode the spectral coefficients and encode a currently to be encoded spectral coefficient of the spectral coefficients by entropy encoding depending, in a context-adaptive manner, on a previously encoded spectral coefficient of the spectral coefficients, with adjusting a relative spectral distance between the previously encoded spectral coefficient and the currently encoded spectral coefficient depending on an information concerning a shape of the spectrum.

Still another embodiment may have a method for decoding spectral coefficients of a spectrum of an audio signal, the spectral coefficients belonging to the same time instant, the method having sequentially, from low to high frequency, decoding the spectral coefficients and decoding a currently to be decoded spectral coefficient of the spectral coefficients by entropy decoding depending, in a context-adaptive manner, on a previously decoded spectral coefficient of the spectral coefficients, with adjusting a relative spectral distance between the previously decoded spectral coefficient and the currently to be decoded spectral coefficient depending on an information concerning a shape of the spectrum.

Another embodiment may have a method for encoding spectral coefficients of a spectrum of an audio signal, the spectral coefficients belonging to the same time instant, the method having sequentially, from low to high frequency, encoding the spectral coefficients and encoding a currently to be encoded spectral coefficient of the spectral coefficients by entropy encoding depending, in a context-adaptive manner, on a previously encoded spectral coefficient of the spectral coefficients, with adjusting a relative spectral distance between the previously encoded spectral coefficient and the currently encoded spectral coefficient depending on an information concerning a shape of the spectrum.

Another embodiment may have a computer program having a program code for performing, when running on a computer, the above methods for decoding and encoding.

Another embodiment may have a decoder configured to decode spectral coefficients of a spectrogram of an audio signal, composed of a sequence of a spectra, the decoder being configured to decode the spectral coefficients along a spectrotemporal path which scans the spectral coefficients spectrally from low to high frequency within one spectrum and then proceeds with spectral coefficients of a temporally succeeding spectrum with decoding, by entropy decoding, a currently to be decoded spectral coefficient of a current spectrum depending, in a context-adaptive manner, on a template of previously decoded spectral coefficients including a spectral coefficient belonging to the current spectrum, the template being positioned at a location of the currently to be decoded spectral coefficient, with adjusting a relative spectral distance between the spectral coefficient belonging to the current spectrum and the currently to be decoded spectral coefficient depending on an information concerning a shape of the spectrum.

It is a basic finding of the present application that the coding efficiency of coding spectral coefficients of a spectrum of an audio signal may be increased by en/decoding a currently to be en/decoded spectral coefficient by entropy en/decoding and, in doing so, to perform the entropy en/decoding depending, in a context-adaptive manner, on a previously en/decoded spectral coefficient, while adjusting a relative spectral distance between the previously en/decoded spectral coefficient and the currently en/decoded spectral coefficient depending on an information concerning a shape of the spectrum. The information concerning the shape of the spectrum may comprise a measure of a pitch or periodicity of the audio signal, a measure of an inter-harmonic distance of the audio signal's spectrum and/or relative locations of formants and/or valleys of a spectral envelope of the spectrum, and on the basis of this knowledge, the spectral neighborhood which is exploited in order to form the context of the currently to be en/decoded spectral coefficients may be adapted to the thus determined shape of the spectrum, thereby enhancing the entropy coding efficiency.

BRIEF DESCRIPTION OF THE DRAWINGS

Embodiments of the present application are described herein below with respect to the figures, among which

FIGS. 16*a-c* show modified context template configurations or a mapped context in accordance with embodiments of the present application;

DETAILED DESCRIPTION OF THE INVENTION

Figure 1:
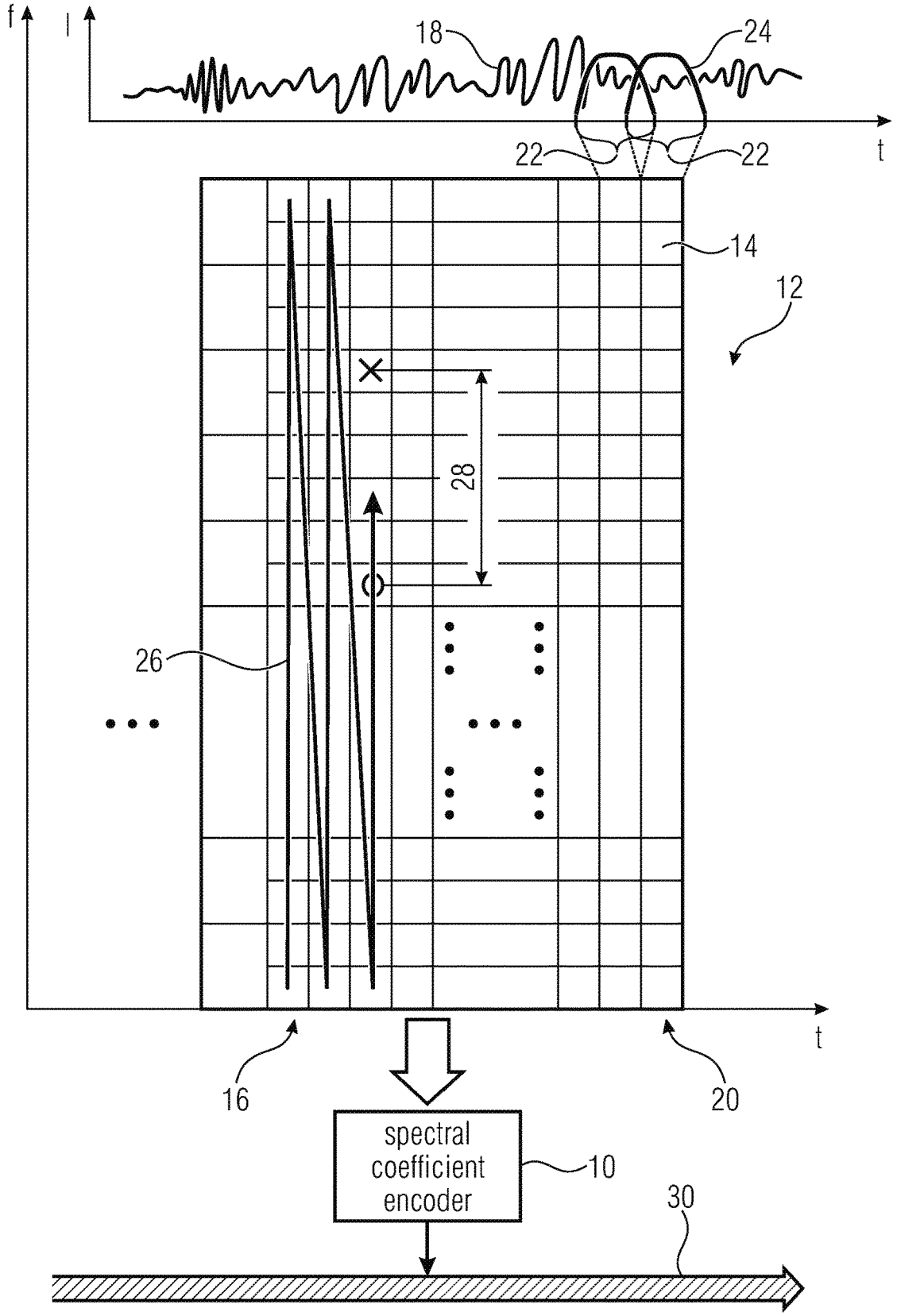
FIG. 1 shows a schematic diagram illustrating a spectral coefficient encoder and its mode of operation in encoding the spectral coefficients of a spectrum of an audio signal.

FIG. 1 shows a spectral coefficient encoder 10 in accordance with an embodiment. The encoder is configured to encode spectral coefficients of a spectrum of an audio signal. FIG. 1 illustrates sequential spectras in the form of a spectrogram 12. To be more precise, the spectral coefficients 14 are illustrated as boxes spectrotemporally arranged along a temporal axis t and a frequency axis f. While it would be possible that the spectrotemporal resolution keeps constant, FIG. 1 illustrates that the spectrotemporal resolution may vary over time with one such time instant being illustrated in FIG. 1 at 16. This spectrogram 12 may be the result of a spectral decomposition transform applied to the audio signal 18 at different time instants, such as a lapped transform such as, for example, a critically-sampled transform, such as an MDCT or some other real-valued critically sampled transform. Insofar, spectrogram 12 may be received by spectral coefficient encoder 10 in the form of a spectrum 20 consisting of a sequence of transform coefficients each belonging to the same time instant. The spectra 20, thus respresent spectral slices of the spectrogram and are illustrated in FIG. 1 as individual columns of spectrogram 12. Each spectrum is composed of a sequence of transform coefficients 14 and has been derived from a corresponding time frame 22 of audio signal 18 using, for example, some window function 24. In particular, the time frames 22 are sequentially arranged at the afore-mentioned time instances and are associated with the temporal sequence of spectra 20. They may, as illustrated in FIG. 1, overlap each other, just as the corresponding transform windows 24 may do. That is, as used herein, "spectrum" denotes spectral coefficients belonging to the same time instant and, thus, is a frequency decomposition. "Spectrogram" is a time-frequency decomposition made of consecutive spectra, wherein "Spectra" is the plural of spectrum. Sometimes, though, "spectrum" is used synonymously for spectrogram. "transform coefficient" is used synonymously to "spectral coefficient", if original signal is in time domain and transformation is a frequency transformation.

As just outlined, the spectral coefficient encoder 10 is for encoding the spectral coefficients 14 of spectrogram 12 of the audio signal 18 and to this end the encoder may, for example, apply a predetermined coding/decoding order which traverses, for example, the spectral coefficients 14 along a spectrotemporal path which, for example, scans the spectral coefficients 14 spectrally from low to high frequency within one spectrum 20 and then proceeds with the spectral coefficients of the temporally succeeding spectrum 20 as outlined in FIG. 1 at 26.

In a manner outlined in more detail below, the encoder 10 is configured to encode a currently to be encoded spectral coefficient, indicated using a small cross in FIG. 1, by entropy encoding depending, in a context-adaptive manner, on one or more previously encoded spectral coefficients, exemplarily indicated using a small circle in FIG. 1. In particular, the encoder 10 is configured so as to adjust a relative spectral distance between the previously encoded spectral coefficient and the currently encoded spectral coefficient depending on an information concerning a shape of the spectrum. As to the dependency and information concerning the shape of the spectrum, details are set out in the following along with considerations concerning the advantages resulting from the adaptation of the relative spectral distance 28 depending on the just mentioned information.

In other words, the spectral coefficient encoder 10 encodes the spectral coefficients 14 sequentially into a data stream 30. As will be outlined in more detail below, the spectral coefficient encoder 10 may be part of a transform-based encoder which, in addition to the spectral coefficients 14, encodes into data stream 30 further information so that the data stream 30 enables a reconstruction of the audio signal 18.

Figure 2:
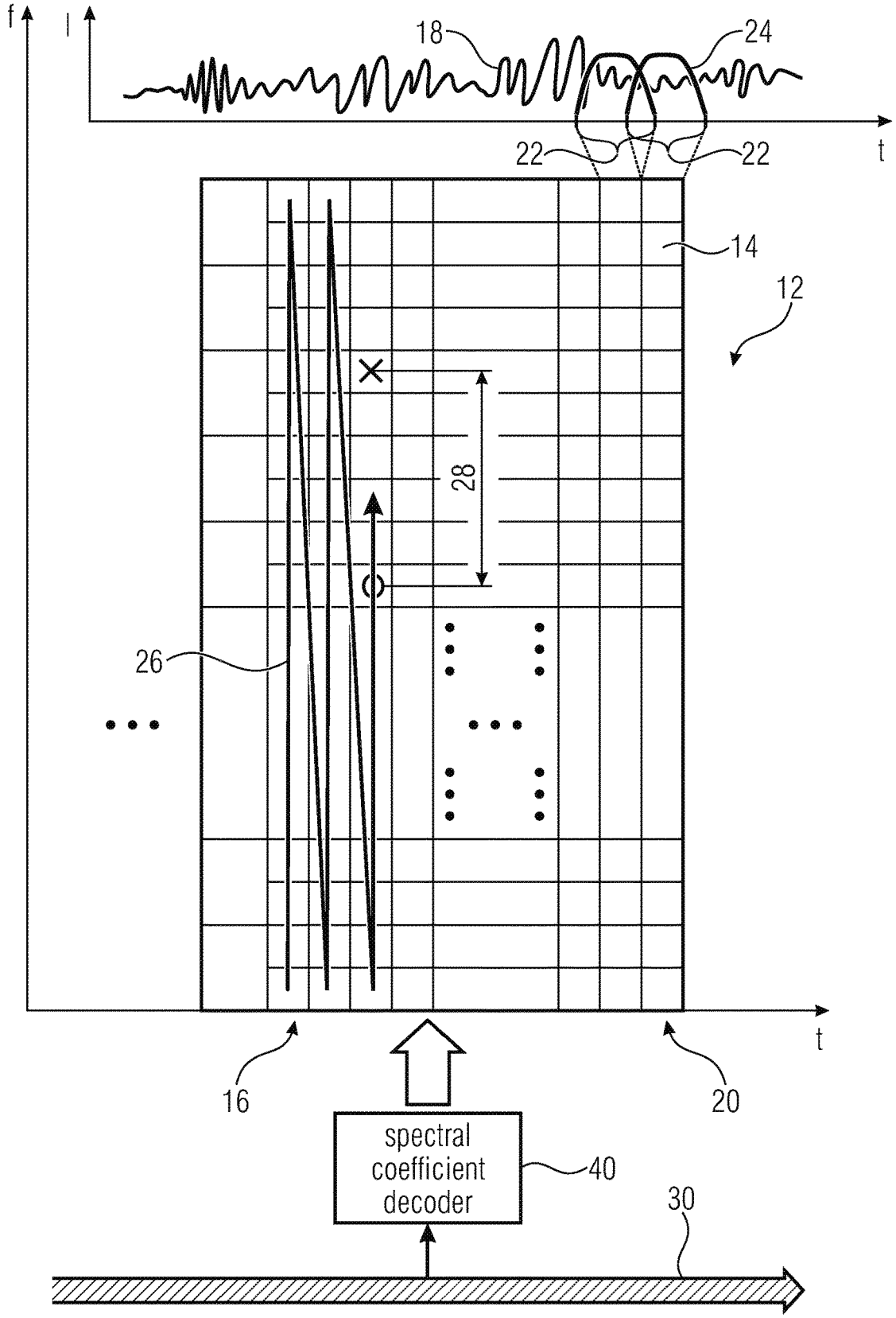
FIG. 2 shows a schematic diagram illustrating a spectral coefficient decoder fitting to the spectral coefficient encoder of FIG. 1.

FIG. 2 shows a spectral coefficient decoder 40 fitting to the spectral coefficient encoder 10 of FIG. 1. The functionality of the spectral coefficient decoder 40 is substantially a reversal of the spectral coefficient encoder 10 of FIG. 1: the spectral coefficient decoder 40 decodes the spectral coefficients 14 of the spectrum 12 using, for example, the decoding order 26 sequentially. In decoding a currently to be decoded spectral coefficient exemplarily indicated using the small cross in FIG. 2 by entropy decoding, spectral coefficient decoder 40 performs the entropy decoding depending, in a context-adaptive manner, on one or more previously decoded spectral coefficients also indicated by a small circle in FIG. 2. In doing so, the spectral coefficient decoder 40 adjusts the relative spectral distance 28 between the previously decoded spectral coefficient and the currently to be decoded spectral coefficient depending on the aforementioned information concerning the shape of the spectrum 12. In the same manner as was indicated above, the spectral coefficient decoder 40 may be part of a transform-based decoder configured to reconstruct the audio signal 18 from data stream 30, from which spectral coefficient decoder 40 decodes the spectral coefficients 14 using entropy decoding. The latter transform-based decoder may, as a part of the reconstruction, subject the spectrum 12 to an inverse transformation such as, for example, an inverse lapped-transform, which for example results in a reconstruction of the sequence of overlapping windowed time frames 22 which, by an overlap-and-add process removes, for example, aliasing resulting from the spectral decomposition transform.

As will be described in more detail below, advantages resulting from adjusting the relative spectral distance 28 depending on the information concerning the shape of the spectrum 12 relies on the ability to improve the probability distribution estimation used to entropy en/decode the current spectral coefficient x. The better the probability distribution estimation, the more efficient the entropy coding is, i.e. more compressed. The "probability distribution estimation" is an estimate of the actual probability distribution of the current spectral coefficient 14, i.e. a function which assigns a probability to each value of a domain of values which the current spectral coefficient 14 may assume. Owing to the dependency of the adaptation of distance 28 on the spectrum's 12 shape, the probability distribution estimation may be determined so as to more closely correspond to the actual probability distribution, since the exploitation of the information on the spectrum's 12 shape enables to derive the probability distribution estimation from a spectral neighborhood of the current spectral coefficient x which allows a more accurate estimation of the probability distribution of the current spectral coefficient x. Details in this regard are presented below along with examples of the information on the spectrum's 12 shape.

Figures 3, 4:
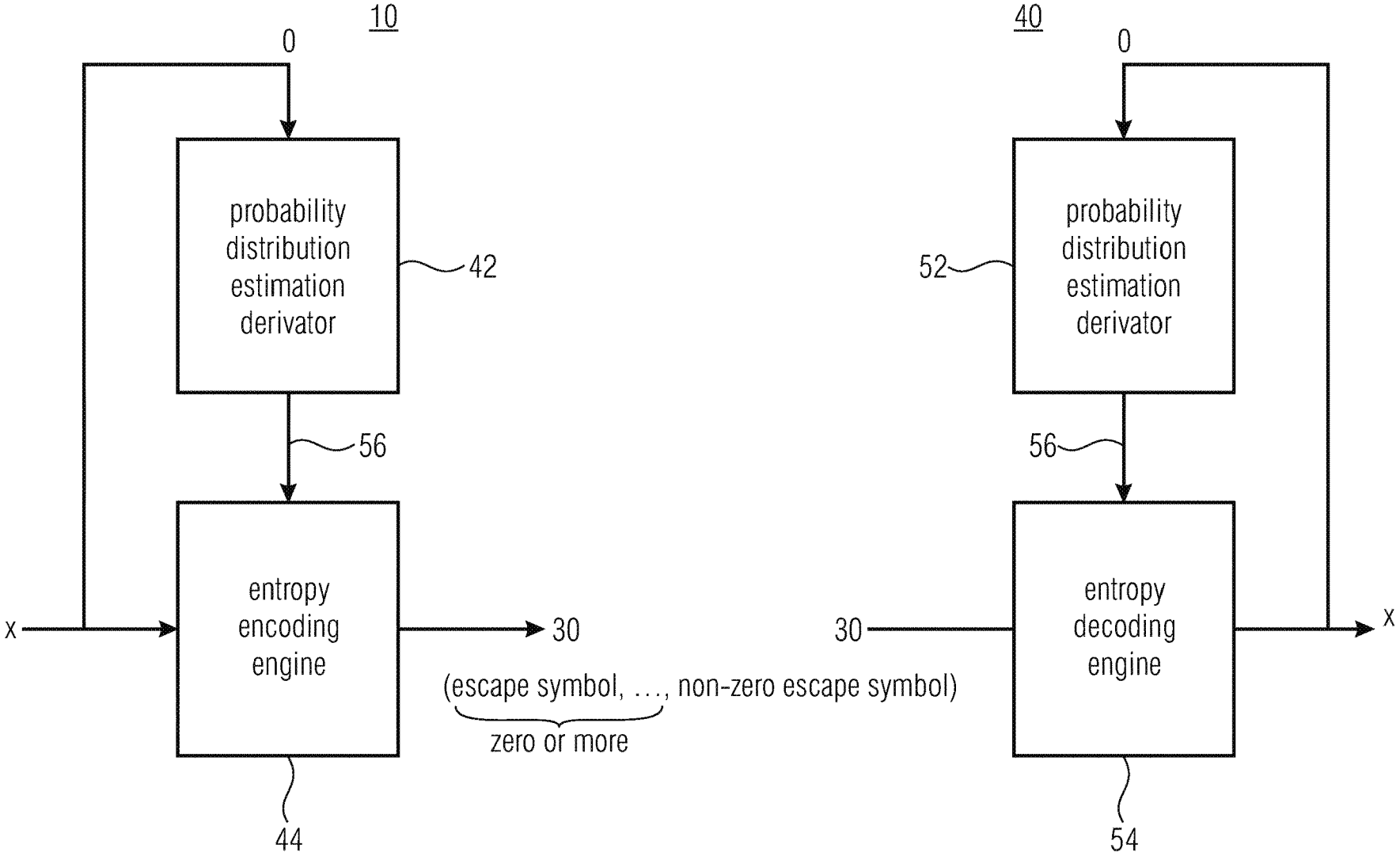
FIG. 3 shows a block diagram of a possible internal structure of the spectral coefficient encoder of FIG. 1 in accordance with an embodiment.
FIG. 4 shows a block diagram of a possible internal structure of the spectral coefficient decoder of FIG. 2 in accordance with an embodiment.

Before proceeding with specific examples of the aforementioned information on the spectrum's 12 shape, FIGS. 3 and 4 show possible internal structures of spectral coefficient encoder 10 and spectral coefficient decoder 40, respectively. In particular, as shown in FIG. 3, the spectral coefficient encoder 10 may be composed of a probability distribution estimation derivator 42 and an entropy encoding engine 44, wherein, likewise, spectral coefficient decoder 40 may be composed of a probability distribution estimation derivator 52 and an entropy decoding engine 54. Probability distribution estimation derivators 42 and 52 operate in the same manner: they derivate, on the basis of the value of the one or more previously decoded/encoded spectral coefficients o, the probability distribution estimation 56 for entropy decoding/encoding the current spectral coefficient x. In particular, the entropy encoding/decoding engine 44/54 receives the probability distribution estimation from derivator 42/52, and performs the entropy encoding/decoding regarding the current spectral coefficient x accordingly.

The entropy encoding/decoding engine 44/54 may use, for example, variable length coding such as Huffman coding for encoding/decoding the current spectral coefficient x and in this regard, the engine 44/54 may use different VLC (variable length coding) tables for different probability distribution estimations 56. Alternatively, engine 44/54 may use arithmetic encoding/decoding with respect to the current spectral coefficient x with the probability distribution estimation 56 controlling the probability interval subdivisioning of the current probability interval representing the arithmetic coding/decoding engines' 44/54 internal state, each partial interval being assigned to a different possible value out of a target range of values which may be assumed by the current spectral coefficient x. As will be outlined in more detail below, the entropy encoding engine and entropy decoding engine 44 and 54 may use an escape mechanism in order to map the spectral coefficient's 14 overall value range onto a limited integer value interval, i.e. the target range, such as $[0 \ldots 2^N-1]$. The set of integer values in the target range, i.e. $\{0, \ldots, 2^{N-1}\}$ defines, along with an escape symbol {esc}, the symbol alphabet of the arithmetic encoding/decoding engine 44/54, i.e. $\{0, \ldots, 2^{N-1}, \text{esc}\}$. For example, entropy encoding engine 44 subjects the inbound spectral coefficient x to a division by 2 as often as needed, if any, in order to bring the spectral coefficient x into the aforementioned target interval [0 . . . $2^N-1$] with, for each division, encoding the escape symbol into data stream 30, followed by arithmetically encoding the division remainder—or the original spectral value in case of no division being necessary—into data stream 30. The entropy decoding engine 54, in turn, would implement the escape mechanism as follows: it would decode a current transform coefficient x from data stream 30 as a sequence of 0, 1 or more escape symbols esc followed by a non-escape symbol, i.e. as one of sequences {a}, {esc, a}, {esc, esc, a}, . . . , with a denoting the non-escape symbol. The entropy decoding engine 54 would, by arithmetically decoding the non-escape symbol, obtain a value a within the target interval [0 . . . $2^{N-1}$], for example, and would derive the coefficient value of x by computing the current spectral coefficient's value to be equal to a+2 times the number of escape symbols.

Different possibilities exist with respect to the usage of the probability distribution estimation 56 and the appliance of the same onto the sequence of symbols used to represent current spectral coefficient x: the probability distribution estimation may, for example, be applied onto any symbol conveyed within data stream 30 for spectral coefficient x, i.e. the non-escape symbol as well as any escape symbol, if any. Alternatively, the probability distribution estimation 56 is merely used for the first or the first two or the first n<N of the sequence of 0 or more escape symbols followed by the non-escape symbol using, for example, some default probability distribution estimation for any subsequent one of the sequence of symbols such as an equal probability distribution.

Figure 5:
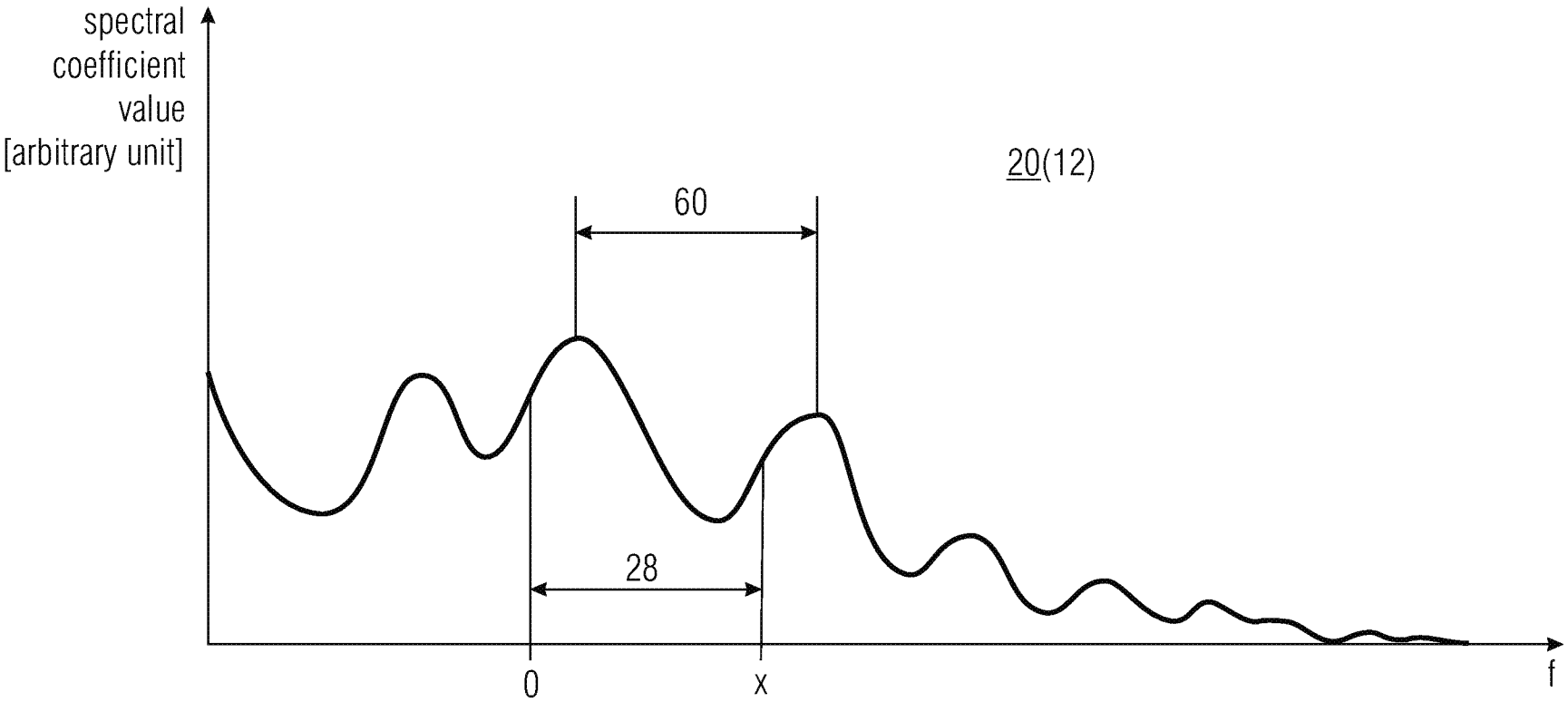
FIG. 5 schematically indicates a graph of a spectrum, the coefficients of which are to be encoded/decoded in order to illustrate the adaptation of the relative spectral distance depending on a measure of a pitch or periodicity of the audio signal or a measure of inter-harmonic distance.

FIG. 5 shows an exemplary spectrum 20 out of spectrogram 12. In particular, the magnitude of spectral coefficients are plotted in FIG. 5 in arbitrary unit along the y axis, whereas the horizontal x axis corresponds to the frequency in arbitrary unit. As already stated, the spectrum 20 in FIG. 5 corresponds to a spectral slice above the audio signal's spectrogram at a certain time instant, wherein the spectrogram 12 is composed of a sequence of such spectra 20. FIG. 5 also illustrates the spectral position of a current spectral coefficient x.

As will be outlined in more detail below, while spectrum 20 may be an unweighted spectrum of the audio signal, in accordance with the embodiments outlined further below, for example, the spectrum 20 is already perceptually weighted using a transfer function which corresponds to the inverse of a perceptual synthesis filter function. However, the present application is not restricted the specific case outlined further below.

In any case, FIG. 5 shows the spectrum 20 with a certain periodicity along the frequency axis which manifests itself in a more or less equidistant arrangement of local maxima and minima in the spectrum along the frequency direction. For illustration purposes only, FIG. 5 shows a measure 60 of a pitch or periodicity of the audio signal as defined by the spectral distance between the local maxima of the spectrum between which the current spectral coefficient x is positioned. Naturally, the measure 60 may be defined and determined differently, such as a mean pitch between the local maxima and/or local minima or the frequency distance equivalent to the time delay maximum measured in the auto-correlation function of the time domain signal 18.

In accordance with an embodiment, measure 60 is, or is comprised by, the information on the spectrum's shape. Encoder 10 and decoder 40 or, to be more precise, probability distribution estimator derivator 42/52 could, for example, adjust the relative spectral distance between the previous spectral coefficient o and the current spectral coefficient x depending on this measure 60. For example, the relative spectral distance 28 could be varied depending on measure 60 such that distance 28 increases with increasing measure 60. For example, it could be favorable to set distance 28 to be equal to measure 60 or to be an integer multiple thereof.

As will be described in more detail below, there are different possibilities as to how the information on the spectrum's 12 shape is made available to the decoder. In general, this information, such as measure 60, may be signaled to the decoder explicitly with only encoder 10 or probability distribution estimator derivator 42 actually determining the information on the spectrum's shape, or the determination of the information on the spectrum's shape is performed at encoder and decoder sides in parallel based on a previously decoded portion of the spectrum, or be can be deduced from another information already written in the bitstream.

Using a different term, measure 60 could also be interpreted as a "measure of inter-harmonic distance" since the afore-mentioned local maxima or hills in the spectrum may form harmonics to each other.

Figure 6:
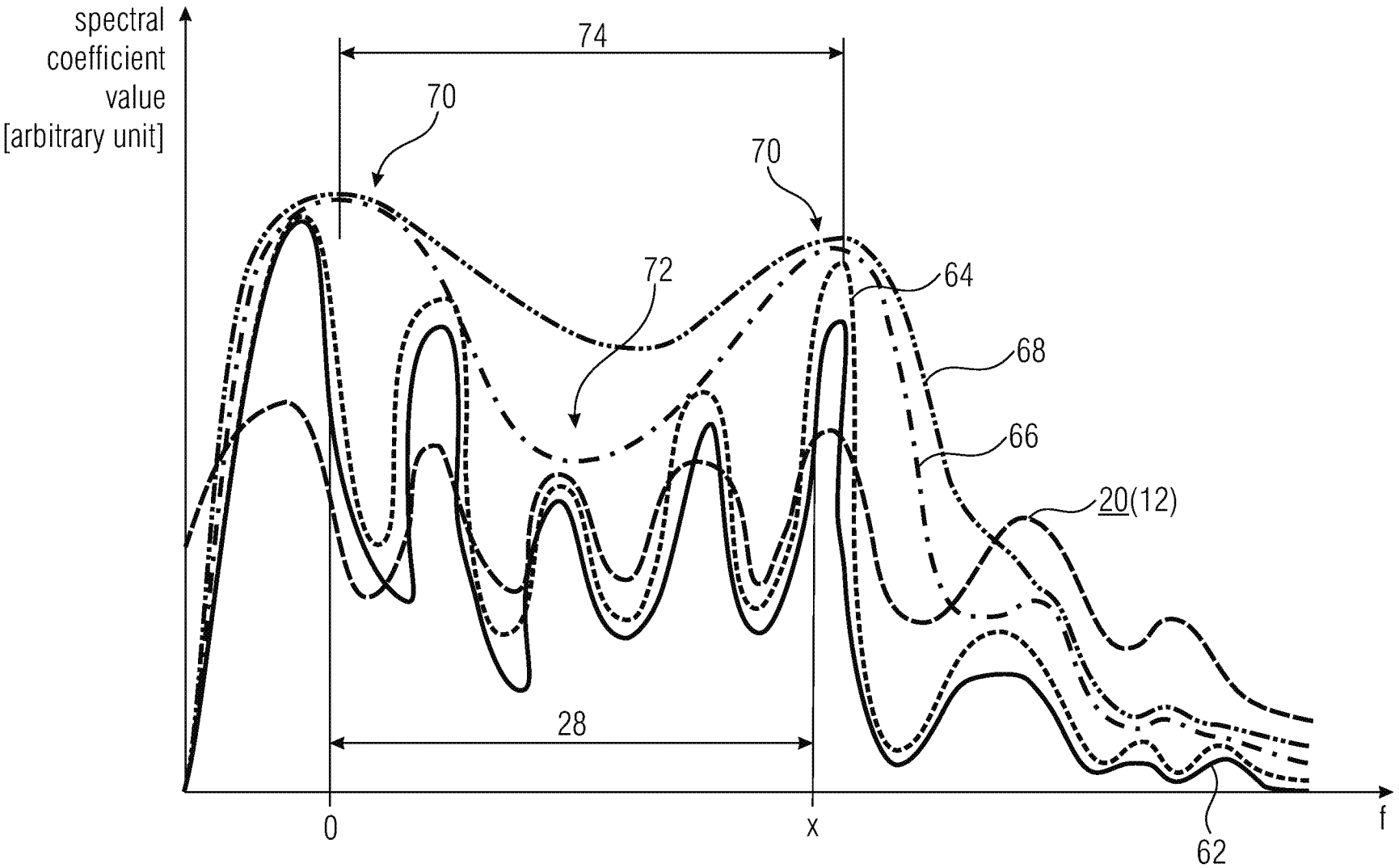
FIG. 6 shows a schematic diagram illustrating a spectrum, the spectral coefficients of which are to be encoded/decoded in accordance with an embodiment where the spectrum is spectrally shaped according to an LP-based perceptually weighted synthesis filter, namely the inverse thereof, with illustrating the adaptation of the relative spectral distance depending on an inter-formant distance measure in accordance with an embodiment.

FIG. 6 provides another example of an information on the spectrum's shape on the basis of which the spectral distance 28 may be adjusted—either exclusively or along with another measure such as measure 60 as described previously. In particular, FIG. 6 illustrates the exemplary case where the spectrum 12 represented by the spectral coefficients encoded/decoded by encoder 10 and decoder 40, a spectral slice of which is shown in FIG. 6, is weighted using the inverse of a perceptually weighted synthesis filter function. That is, the original and finally reconstructed audio signal's spectrum is shown in FIG. 6 at 62. The pre-emphasized version is shown at 64 with dotted line. The linear prediction estimated spectral envelope of the pre-emphasized version 64 is shown with a dash-dot-line 66 and the perceptually modified version thereof, i.e. the transfer function of the perceptually motivated synthesis filter function is shown in FIG. 6 at 68 using a dash-dot-dot line. The spectrum 12 may be the result of the filtering of the pre-emphasized version of the original audio signal spectrum 62 with the inverse of the perceptually weighted synthesis filter function 68. In any case, both encoder and decoder may have access to the spectral envelope 66 which, in turn, may have more or less pronounced formants 70 or valleys 72. In accordance with an alternative embodiment of the present application, the information concerning the spectrum's shape is at least partially defined based on relative locations of these formants 70 and/or valleys 72 of the spectrum's 12 spectral envelope 66. For example, the spectral distance 74 between formants 70 may be used to set the aforementioned relative spectral distance 28 between the current spectral coefficient x and the previous spectral coefficient o. For example, the distance 28 may be advantageously set to be equal to, or to be an integer multiple of, distance 74, wherein however alternatives are also feasible.

Instead of a LP based envelope as illustrated in FIG. 6, a spectral envelope may also be defined differently. For example, the envelope may be defined and transmitted in the data stream by way of scale factors. Other ways of transmitting the envelope may be used as well.

Owing to the adjustment of the distance 28 in the manner outlined above with respect to FIGS. 5 and 6, the value of the "reference" spectral coefficient o represents a substantially better hint for estimating the probability distribution estimation for the current spectral coefficient x than compared to other spectral coefficients which lie, for example, spectrally nearer to the current spectral coefficient x. In this regard, it should be noted that the context modeling is in most cases a compromise between entropy coding complexity on the one hand and coding efficiency on the other hand. Thus, the embodiments described so far suggest an adaptation of the relative spectral distance 28 depending on the information on the spectrum's shape so that, for example, the distance 28 increases with increasing measure 60 and/or increasing inter-formant distance 74. However, the number of previous coefficients o on the basis of which the context-adaptation of the entropy coding/decoding is performed, may be constant, i.e. may not increase. The number of previous spectral coefficients o, on the basis of which the context-adaptation is performed, may for example be constant irrespective of the variation of the information concerning the spectrum's shape. This means that adapting the relative spectral distance 28 in the manner outlined above leads to a better, or more efficient, entropy encoding/decoding without significantly increasing the overhead of performing the context modeling. Merely the adaptation of the spectral distance 28 itself increases the context modeling overhead.

Figure 7:
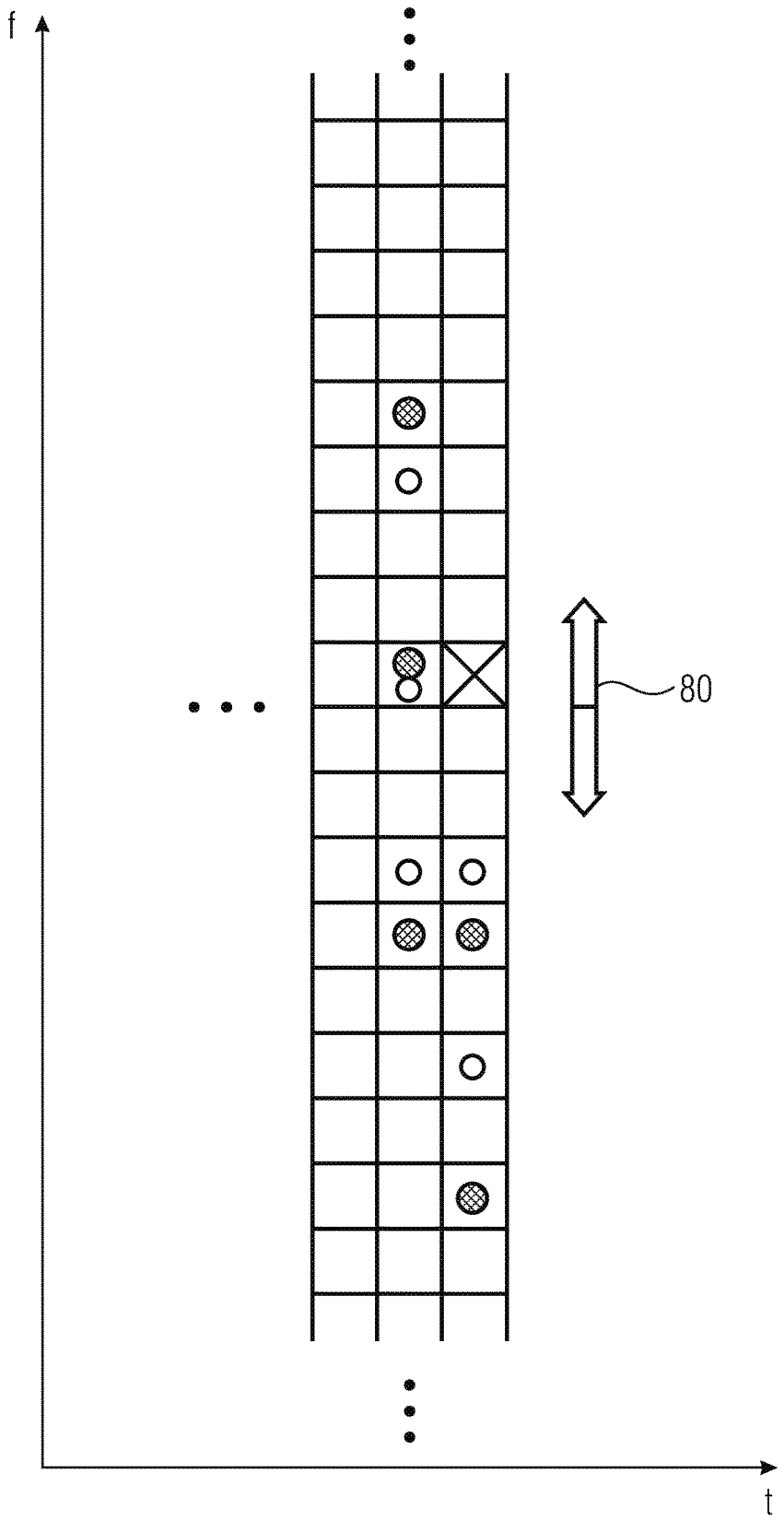
FIG. 7 schematically illustrates a portion of the spectrum in order to illustrate the context template surrounding the spectral coefficient to be currently coded/decoded and the adaptation of the context templates spectral spread depending on the information on the spectrum's shape in accordance with an embodiment.

In order to illustrate the just mentioned issue in more detail, reference is made to FIG. 7 which shows a spectrotemporal portion out of spectrogram 12, the spectrotemporal portion including the current spectral coefficient 14 to be coded/decoded. Further, FIG. 7 illustrates a template of exemplarily five previously coded/decoded spectral coefficients o on the basis of which the context modeling for the entropy coding/decoding of the current spectral coefficient x is performed. The template is positioned at the location of the current spectral coefficient x and indicates the neighboring reference spectral coefficients o. Depending on the aforementioned information on the spectrum's shape, the spectral spread of the spectral positions of these reference spectral coefficients o is adapted. This is illustrated in FIG. 7 using a double-headed arrow 80 and hatched small circles which exemplarily illustrate the reference spectral coefficients' positions in case of, for example, scaling the spectral spread of spectral positions of the reference spectral coefficients depending on the adaptation 80. That is, FIG. 7 shows that the number of reference spectral coefficients contributing to the context modeling, i.e. the number of reference spectral coefficients of the template surrounding the current spectral coefficient x and identifying the reference spectral coefficients o, keeps constant irrespective of any variation of the information on the spectrum's shape. Merely the relative spectral distance between these reference spectral coefficients and the current spectral coefficient is adapted according to 80, and inherently the distance between the reference spectral coefficients themselves. However, it is noted that the number of reference spectral coefficients o is not necessarily kept constant. In accordance with an embodiment, the number of reference spectral coefficients could increase with increasing relative spectral distance. The opposite would, however, also be feasible.

Figure 8:
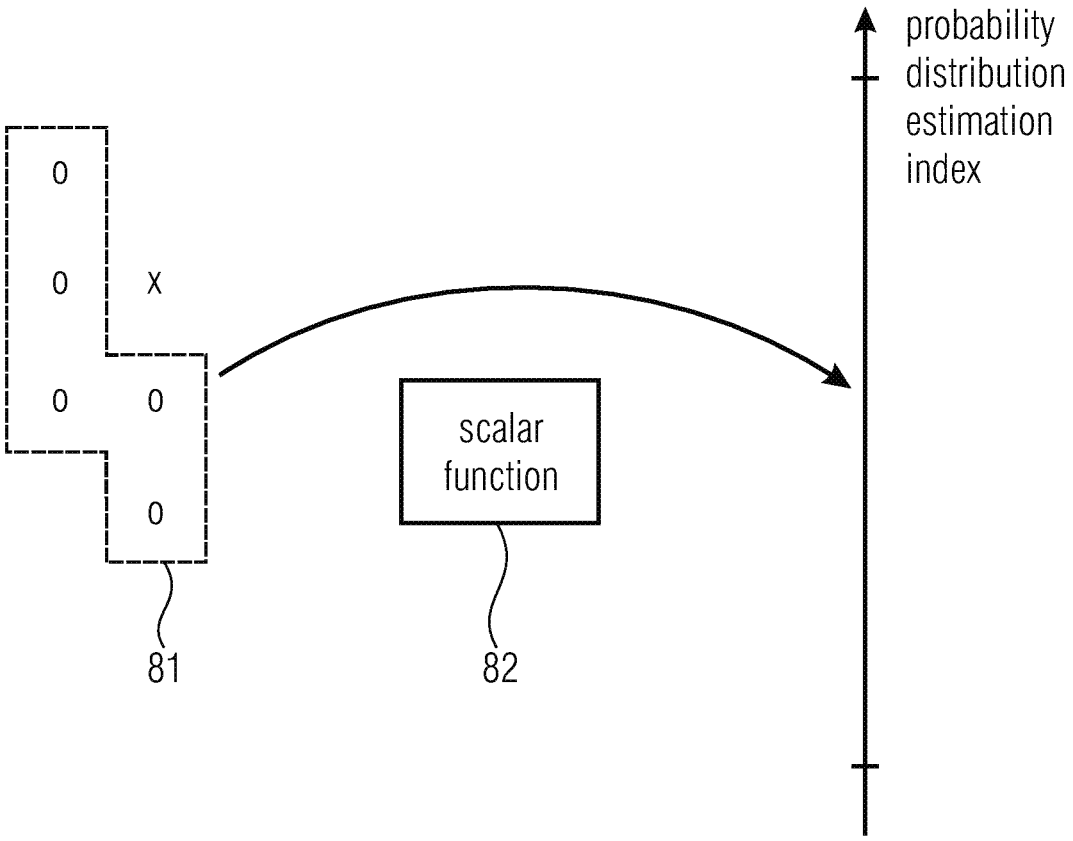
FIG. 8 shows a schematic diagram illustrating the mapping from the one or more values of the reference spectral coefficients of the context template 81 using a scalar function so as to derive the probability distribution estimation to be used for encoding/decoding the current spectral coefficient in accordance with an embodiment.

It is noted that FIG. 7 shows the exemplary case where the context modeling for the current spectral coefficient x also involves previously coded/decoded spectral coefficients corresponding to an earlier spectrum/temporal frame. This is, however, also merely to be understood as an example and the dependency on such temporally preceding previously coded/decoded spectral coefficients may be left off in accordance with a further embodiment. FIG. 8 illustrates how the probability distribution estimation derivator 42/52 may, on the basis of the one or more reference spectral coefficients o, determine the probability distribution estimation for the current spectral coefficient. As illustrated in FIG. 8, to this end the one or more reference spectral coefficients o may be subject to a scalar function 82. On the basis of the scalar function, for example, the one or more reference spectral coefficients o are mapped onto an index indexing the probability distribution estimation to be used for the current spectral coefficient x out of a set of available probability distribution estimations. As already mentioned above, the available probability distribution estimations may, for example, correspond to different probability interval subdivisionings for the symbol alphabet in the case of arithmetic coding, or to different variable length coding tables in the case of using variable length coding.

Before proceeding with the description of a possible integration of the above-described spectral coefficient encoder/decoders into respective transform-based encoders/decoders, several possibilities are discussed herein below as to how the embodiments described so far could be varied. For instance, the escape mechanism briefly outlined above with respect to FIG. 3 and FIG. 4 has been chosen only for illustration purposes and may be left off in accordance with an alternative embodiment. In the embodiment described below, the escape mechanism is used. Moreover, as will become clear from the description of more specific embodiments outlined below, instead of encoding/decoding the spectral coefficients individually, same may be encoded/decoded in units of n-tuples, i.e. in units of n spectrally immediately neighboring spectral coefficients. In that case, the determination of the relative spectral distance may also be determined in units of such n-tuples, or in units of individual spectral coefficients. With regard to the scalar function 82 of FIG. 8, it is noted that the scalar function may be an arithmetic function or a logical operation. Moreover, special measures may be taken for those reference scalar coefficients o which, for example, are unavailable due to, for example, exceeding the spectrum's frequency range or for example lying in a portion of the spectrum sampled by the spectral coefficients at a spectrotemporal resolution different from the spectrotemporal resolution at which the spectrum is sampled at the time instant corresponding to the current spectral coefficient. The values of unavailable reference spectral values o may be replaced by default values, for example, and then input into scalar function 82 along with the other (available) reference spectral coefficients. Another way how the entropy coding/decoding could work using the spectral distance adaptation outlined above is as follows: for example, the current spectral coefficient could be subject to a binarization. For example, the spectral coefficient x could be mapped onto a sequence of bins which are then entropy encoded using the adaptation of the relative spectral distance adaptation. When decoding, the bins would be entropy decoded sequentially until a valid bin sequence is encountered, which may then be re-mapped to the respective values of the current spectral coefficient x.

Further, the context-adaptation depending on the one or more previous spectral coefficients o could be implemented in a manner different from the one depicted in FIG. 8. In particular, the scalar function 82 could be used to index one out of a set of available contexts and each context could have associated therewith a probability distribution estimation. In that case, the probability distribution estimation associated with a certain context could be adapted to the actual spectral coefficient statistics each time the currently coded/decoded spectral coefficient x has been assigned to the respective context, namely using the value of this current spectral coefficient x.

Figure 9A:
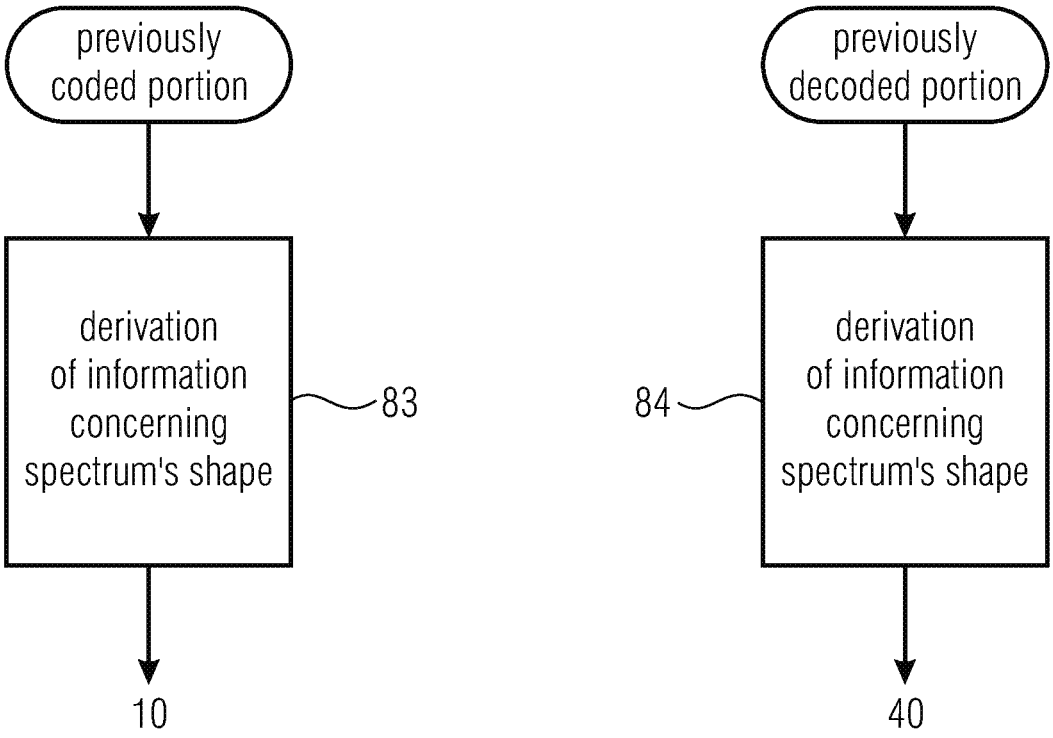
FIG. 9*a* schematically illustrates the usage of implicit signaling in order to synchronize the adaptation of the relative spectral distance between encoder and decoder.
Figure 9B:
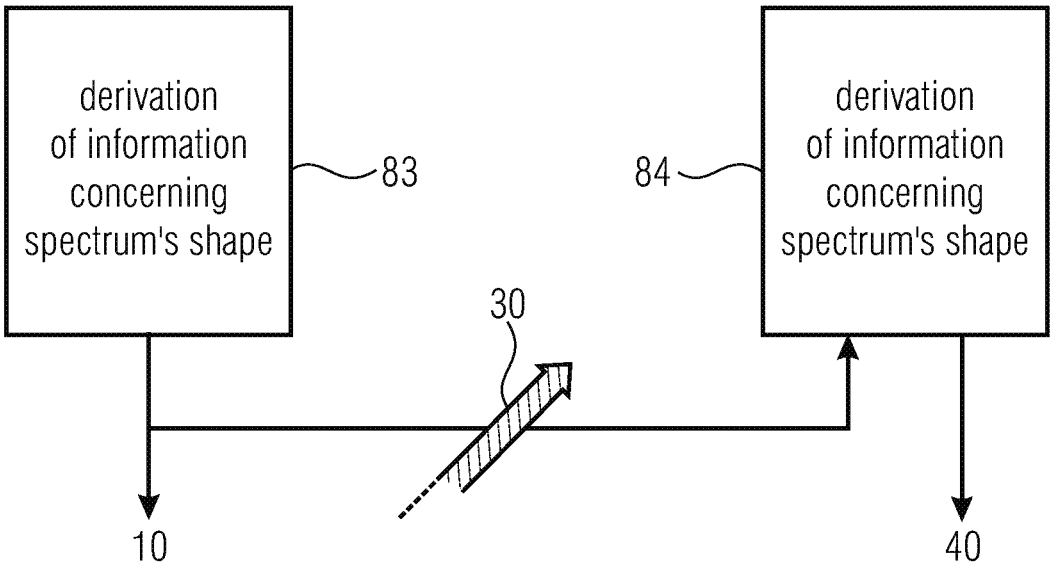
FIG. 9*b* shows a schematic diagram illustrating the usage of explicit signaling in order to synchronize the adaptation of the relative spectral distance between encoder and decoder.

Finally, FIGS. 9*a* and 9*b* show different possibilities as to how the derivation of the information concerning the spectrum's shape may be synchronized between encoder and decoder. FIG. 9*a* shows the possibility according to which implicit signaling is used so as to synchronize the derivation of the information concerning the shape of the spectrum between encoder and decoder. Here, at both the encoding and decoding side, the derivation of the information is performed based on a previously coded portion or previously decoded portion of the bitstream 30 respectively, the derivation at the encoding side being indicated using reference sign 83 and the derivation at the decoding side being indicated using reference sign 84. Both derivations may be performed, for example, by derivators 42 and 52 themselves.

FIG. 9*b* illustrates a possibility according to which explicit signalization is used in order to convey the information concerning the spectrum's shape from encoder to decoder. The derivation 83 at the encoding side may even involve an analysis of the original audio signal including components thereof which are, owing to coding loss, not available at the decoding side. Rather, explicit signaling within data stream 30 is used to render the information concerning the spectrum's shape available at the decoding side. In other words, the derivation 84 at the decoding side uses the explicit signalization within data stream 30 so as to obtain access to the information concerning the spectrum's shape. The explicit signalization 30 may involve differentially coding. As will be outlined in more detail below, for example, the LTP (long term prediction) lag parameter already available in data stream 30 for other purposes may be used as the information concerning the spectrum's shape. Alternatively, however, the explicit signalization of FIG. 9*b* may differentially code measure 60 in relation to, i.e. differentially to, the already available LTP lag parameter. Many other possibilities exist so as to render the information concerning the spectrum's shape available to the decoding side.

In addition to the alternative embodiments set out above, it is noted that the en/decode of the spectral coefficients may, in addition to the entropy en/decoding, involve spectrally and/or temporally predicting the currently to be en/decoded spectral coefficient. The prediction residual may then be subject to the entropy en/decoding as described above.

After having described various embodiments for the spectral coefficient encoder and decoder, in the following some embodiments are described as to how the same may be advantageously built into a transform-based encoder/decoder.

Figure 10A:
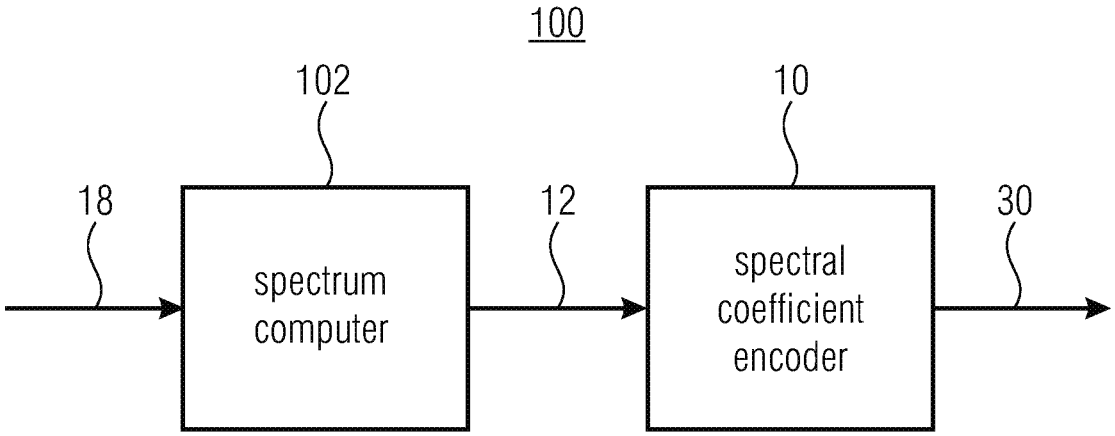
FIG. 10*a* shows a block diagram of a transform-based audio encoder in accordance with an embodiment.
Figure 10B:
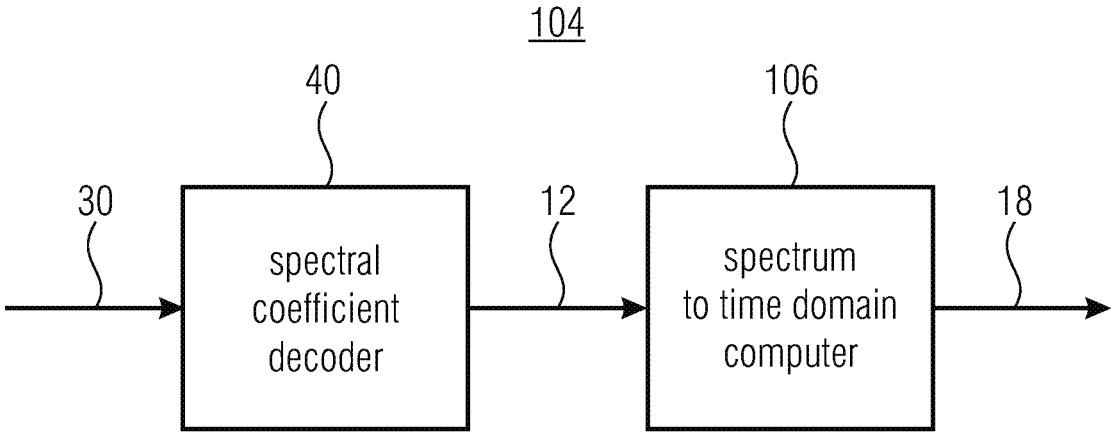
FIG. 10*b* shows a block diagram of a transform-based audio decoder fitting to the encoder of FIG. 10*a;*

FIG. 10*a*, for example, shows a transform-based audio encoder in accordance with an embodiment of the present application. The transform-based audio encoder of FIG. 10*a* is generally indicated using reference sign 100 and comprises a spectrum computer 102 followed by the spectral coefficient encoder 10 of FIG. 1. The spectrum computer 102 receives the audio signal 18 and computes on the basis of the same the spectrum 12, the spectral coefficients of which are encoded by spectral coefficient encoder 10 as described above into data stream 30. FIG. 10*b* shows the construction of the corresponding decoder 104: the decoder 104 comprises a concatenation of a spectral coefficient decoder 40 formed as outlined above, and in the case of FIGS. 10*a* and 10*b*, spectrum computer 102 may, for example, merely perform a lapped transform onto a spectrum 20 with a spectrum to time domain computer 106 correspondingly merely performing the inverse thereof. The spectral coefficient encoder 10 may be configured to losslessly encode the inbound spectrum 20. Compared thereto, spectrum computer 102 may introduce coding loss owing to quantization.

Figure 11A:
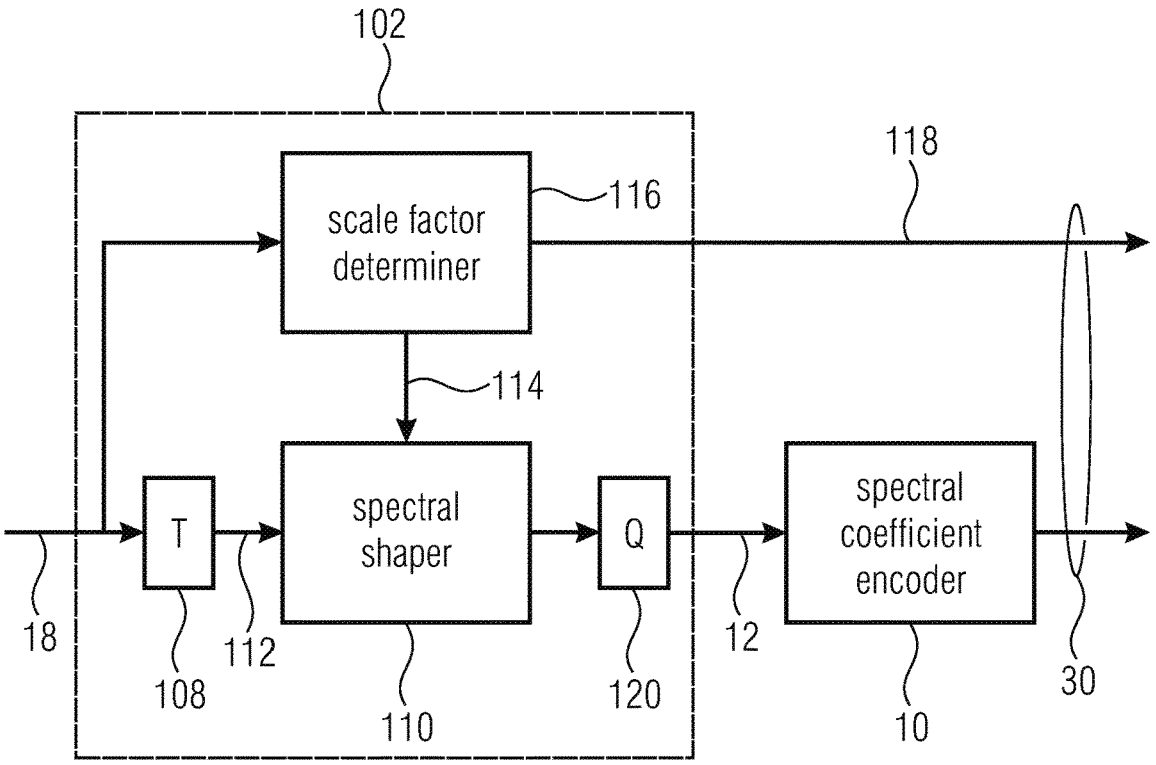
FIG. 11*a* shows a block diagram of a transform-based audio encoder using frequency domain spectral shaping in accordance with an embodiment.

In order to spectrally shape the quantization noise, spectrum computer 102 may be embodied as shown in FIG. 11*a*. Here, the spectrum 12 is spectrally shaped using scale factors. In particular, according to FIG. 11 a the spectrum computer 102 comprises a concatenation of a transformer 108 and a spectral shaper 110 among which transformer 108 subjects the inbound audio signal 18 to a spectral decomposition transform so as to obtain an unshaped spectrum 112 of the audio signal 18, wherein the spectral shaper 110 spectrally shapes this unshaped spectrum 112 using scale factors 114 obtained from a scale factor determiner 116 of spectrum computer 102 so as to obtain spectrum 12 which is finally encoded by spectral coefficient encoder 10. For example, spectral shaper 110 obtains one scale factor 114 per scale factor band from scale factor determiner 116 and divides each spectral coefficient of the respective scale factor band by the scale factor associated with the respective scale factor band so as to receive spectrum 12. The scale factor determiner 116 may be driven by a perceptual model so as to determine the scale factors on the basis of the audio signal 18. Alternatively, scale factor determiner 116 may determine the scale factors based on a linear prediction analysis so that the scale factors represent a transfer function depending on a linear prediction synthesis filter defined by linear prediction coefficient information. The linear prediction coefficient information 118 is coded into data stream 30 along with the spectral coefficients of spectrum 20 by encoder 10. For the sake of completeness, FIG. 11*a* shows a quantizer 120 as being positioned downstream spectral shaper 110 so as to obtain spectrum 12 with quantized spectral coefficients which are then losslessly coded by spectral coefficient encoder 10.

Figure 11B:
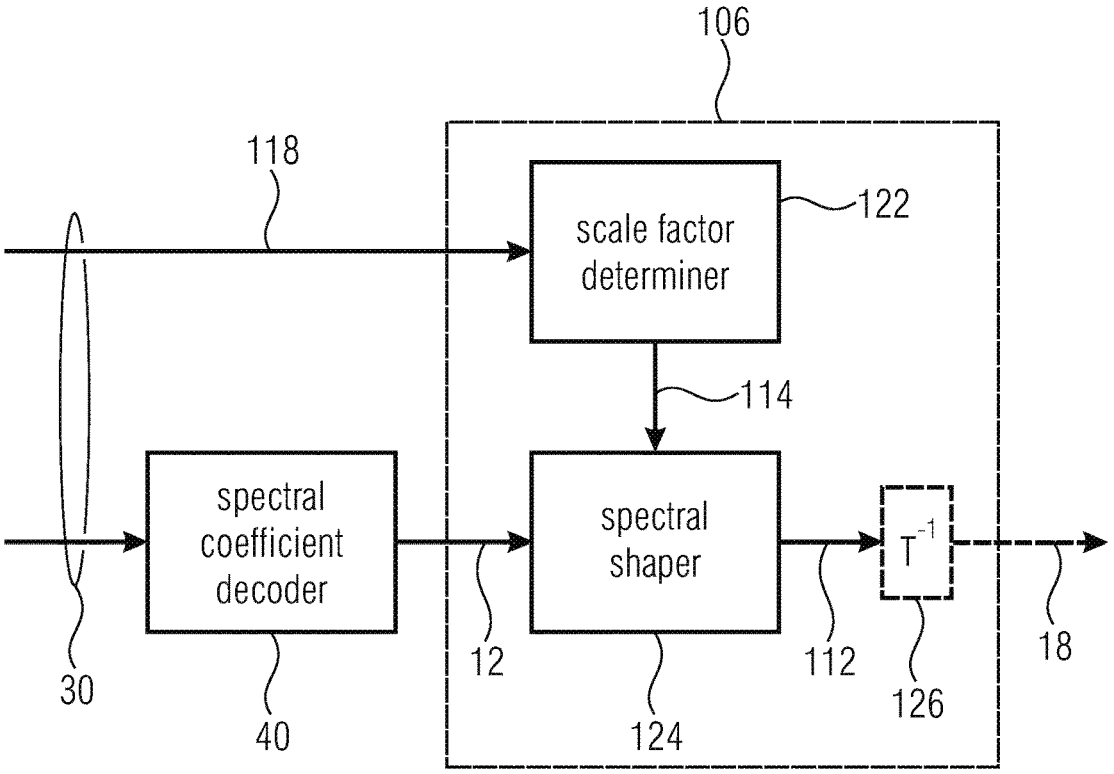
FIG. 11*b* shows a block diagram of a transform-based audio decoder fitting to the encoder of FIG. 11*a;*

FIG. 11*b* shows a decoder corresponding to the encoder of FIG. 10*a*. Here, the spectrum to time domain computer 106 comprises a scale factor determiner 122 which reconstructs the scale factors 114 on the basis of the linear prediction coefficient information 118 contained in the data stream 30 so that the scale factors represent a transfer function depending on a linear prediction synthesis filter defined by the linear prediction coefficient information 118. The spectral shaper spectrally shapes spectrum 12 as decoded by decoder 40 from data stream 30 according to scale factors 114, i.e. spectral shaper 124 scales the scale factors within each spectral band using the scale factor of the respective scale factor band. Thus, at the spectral shaper's 124 output, a reconstruction of the audio signal's 18 unshaped spectrum 112 results and as it is illustrated in FIG. 11*b* by dashed lines, applying an inverse transform onto the spectrum 112 by way of an inverse transformer 126 so as to reconstruct the audio signal 18 in time-domain is optional.

Figure 12A:
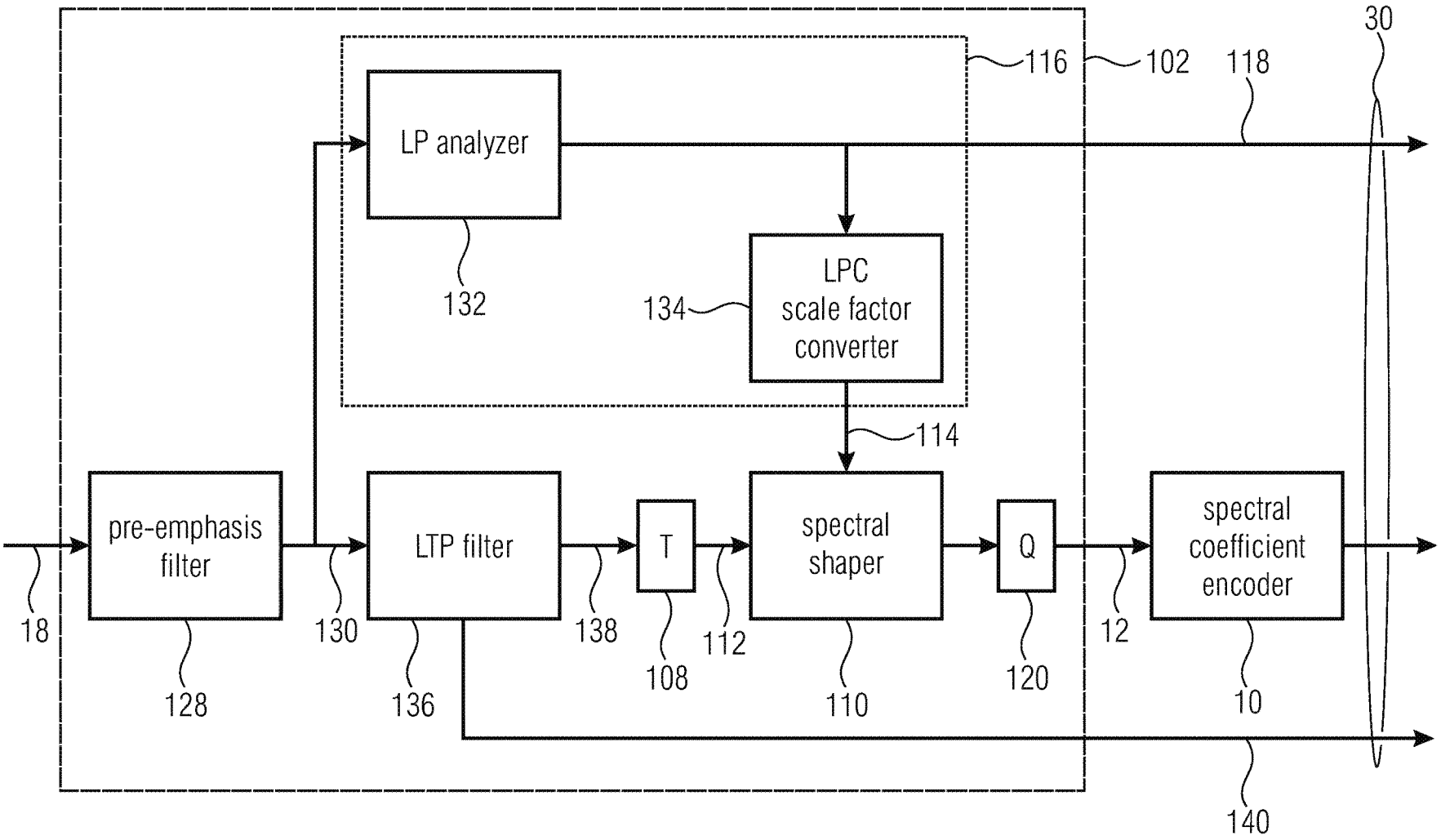
FIG. 12*a* shows a block diagram of a linear prediction-based transform-coded excitation audio encoder in accordance with an embodiment.

FIG. 12*a* shows a more detailed embodiment of the transform-based audio encoder of FIG. 11*a* in the case of using linear prediction based spectrum shaping. In addition to the components shown in FIG. 11*a*, the encoder of FIG. 12*a* comprises a pre-emphasis filter 128 configured to initially subject the inbound audio signal 18 to a pre-emphasis filtering. The pre-emphasis filter 128 may, for example, be implemented as an FIR filter. The pre-emphasis filter's 128 transfer function may, for example, represent a high pass transfer function. In accordance with an embodiment, the pre-emphasis filter 128 is embodied as an n-th order high pass filter such as, for example a one order high pass filter having transfer function $H(z)=1-\alpha z^{-1}$ with a being set, for example, to 0.68. Accordingly, at the output of pre-emphasis filter 128, a pre-emphasized version 130 of audio signal 18 results. Further, FIG. 12*a* shows scale factor determiner 116 as being composed of an LP (linear prediction) analyzer 132 and a linear prediction coefficient to scale factor converter 134. The LPC analyzer 132 computer linear prediction coefficient information 118 on the basis of the pre-emphasized version of audio signal 18. Thus, the linear prediction coefficients of information 118 represent a linear prediction based spectral envelope of the audio signal 18 or, to be more precise, its pre-emphasized version 130. The mode of operation of LP analyzer 132 may, for example, involve a windowing of the inbound signal 130 so as to obtain a sequence of windowed portions of signal 130 to be LP analyzed, an autocorrelation determination so as to determine the autocorrelation of each windowed portion and lag windowing, which is optional, for applying a lag window function onto the autocorrelations. Linear prediction parameter estimation may then be performed onto the autocorrelations or the lag window output, i.e. windowed autocorrelation functions. The linear prediction parameter estimation may, for example, involve the performance of a Wiener-Levinson-Durbin or other suitable algorithm onto the (lag windowed) autocorrelations so as derive linear prediction coefficients per autocorrelation, i.e. per windowed portion of the signal 130. That is, at the output of LP analyzer 132, LPC coefficients 118 result. The LP analyzer 132 may be configured to quantize the linear prediction coefficients for insertion into the data stream 30. The quantization of the linear prediction coefficients may be performed in another domain than the linear prediction coefficient domain such as, for example, in a line spectral pair or line spectral frequency domain. However, other algorithms than a Wiener-Levinson-Durbin algorithm may be used as well.

The linear prediction coefficient to scale factor converter 134 converts the linear prediction coefficients into scale factors 114. Converter 134 may determine the scale factors 140 so as to correspond to the inverse of the linear prediction synthesis filter $1/A(z)$ as defined by the linear prediction coefficient information 118. Alternatively, converter 134 determines the scale factor so as to follow a perceptually motivated modification of this linear prediction synthesis filter such as, for example, $1/A(\gamma \cdot z)$ with $\gamma=0.92\pm10\%$, for example. The perceptually motivated modification of the linear prediction synthesis filter, i.e. $1/A(\gamma \cdot z)$ may be called "perceptual model".

For illustration purposes, FIG. 12*a* shows another element which is, however, optional for the embodiment of FIG. 12*a*. This element is an LTP (long term prediction) filter 136 positioned upstream from transformer 108 so as to subject the audio signal to long term prediction. Advantageously, LP analyzer 132 operates on the non-long-term-prediction filtered version. In other words, the LTP filter 136 performs an LTP prediction onto audio signal 18 or the pre-emphasized version 130 thereof, and output the LTP residual version 138 so that transformer 108 performs the transform onto the pre-emphasized and LTP predicted residual signal 138. The LTP filter may, for example, be implemented as an FIR filter and the LTP filter 136 may be controlled by LTP parameters including, for example, an LTP prediction gain and an LTP lag. Both LTP parameters 140 are coded into the data stream 30. The LTP gain represents, as will be outlined in more detail below, an example for a measure 60 as it indicates a pitch or periodicity which would, without LTP filtering, completely manifest itself in spectrum 12 and, using LTP filtering, occurs in spectrum 12 in a gradually decreased intensity with a degree of reduction depending on the LTP gain parameter which controls the strength of the LTP filtering by LTP filter 136.

Figure 12B:
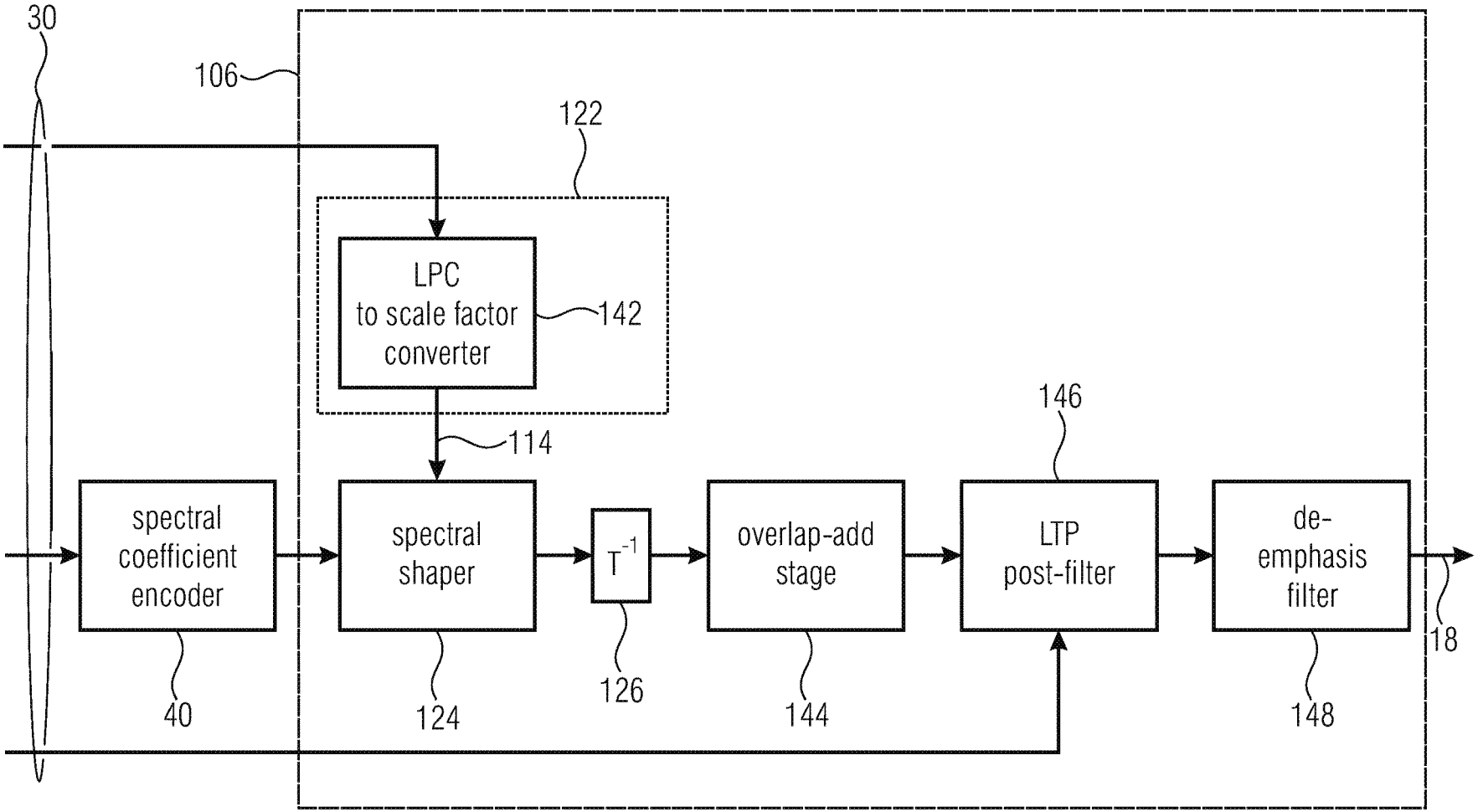
FIG. 12*b* shows a linear-prediction based transform coded excitation audio decoder fitting to the encoder of FIG. 12*a;*

FIG. 12*b* shows, for the sake of completeness, a decoder fitting to the encoder of FIG. 12*a*. In addition to the components of FIG. 11*b* and the fact that scale factor determiner 122 is embodied as an LPC to scale factor converter 142, the decoder of FIG. 12*b* comprises downstream inverse transformer 126 an overlap-add stage 144 subjecting the inverse transforms output by inverse transformer 126 to an overlap add process, thereby obtaining a reconstruction of the pre-emphasized and LTP filtered version 138 which is then subject to LTP post-filtering where LTP post-filter 146, the transfer function of which corresponds to the inverse of LTP filter's 136 transfer function. LTP post-filter 146 may, for example, be implemented in the form of an IIR filter. Sequentially to LTP post-filter 146, in FIG. 12*b* exemplarily downstream thereof, the decoder of FIG. 12*b* comprises a de-emphasis filter 148 which performs a de-emphasis filtering onto the time-domain signal using a transfer function corresponding to the inverse of the pre-emphasis filter's 128 transfer function. De-emphasis filter 148 may also be embodied in the form of an IIR filter. The audio signal 18 results at the output of the emphasis filter 148.

In other words, the embodiments described above provide a possibility for coding tonal signals and frequency domain by adapting the design of an entropy coder context such as an arithmetic coder context to the shape of the signal's spectrums such as the periodicity of the signal. The embodiments described above, frankly speaking, extend the context beyond the notion of neighborhood and propose an adaptive context design based on the audio signals spectrum's shape, such as based on pitch information. Such pitch information may be transmitted to the decoder additionally or may be already available from other coding modules, such as the LTP gain mentioned above. The context is then mapped in order to point to already coded coefficients which are related to the current coefficient to code by a distance multiple or proportional to the fundamental frequency of the input signal.

It should be noted that the LTP pre/postfilter concept used according to FIGS. 12 and 12*b* may be replaced by a harmonic post filter concept according to which an harmonic post filter at the decoder is controlled via LTP parameters including a pitch (or pitch-lag) sent from the encoder to decoder via data stream 30. The LTP parameters may be used as a reference for differentially transmit the aforementioned information concerning the spectrum's shape to the decoder using explicit signaling.

By way of the embodiment outlined above, a prediction for tonal signals may be left off, thereby for example avoiding introducing unwanted inter-frame dependencies. On the other hand, the above concept of coding/decoding spectral coefficients can also be combined with any prediction technique since the prediction residuals still show some harmonic structures.

Figure 13:
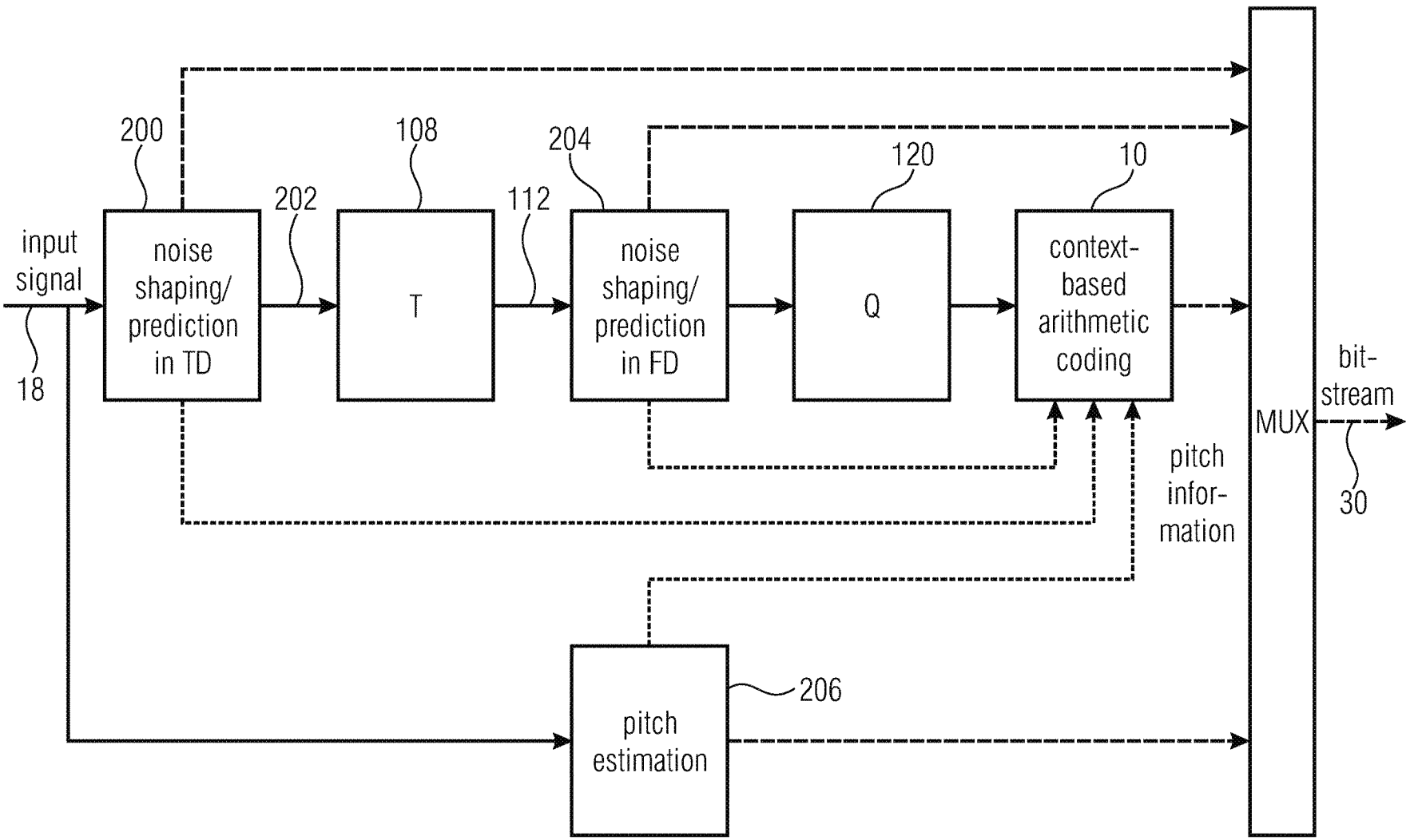
FIG. 13 shows a block diagram of a transform-based audio encoder in accordance with a further embodiment.

Using other words, the embodiments described above are illustrated again with respect to the following figures, among which FIG. 13 shows a general block diagram of an encoding process using the spectral distance adaptation concept outlined above. In order to ease the concordance between the following description and the description brought forward so far, the reference signs are partially reused.

The input signal 18 is first conveyed to the noise shaping/prediction in TD (TD=time domain) module 200. Module 200 encompasses, for example, one or both of elements 128 and 136 of FIG. 12*a*. This module 200 can be bypassed or it can perform a short-term prediction by using a LPC coding, and/or—as illustrated in FIG. 12*a*—a long-term prediction. Every kind of prediction can be envisioned. If one of the time domain processings exploits and transmits a pitch information, as it has been briefly outlined above by way of the LTP lag parameter output by LTP filter 136, such an information can be then conveyed to the context-based arithmetic coder module for the sake of pitch-based context mapping.

Then, the residual and shaped time-domain signal 202 is transformed by transformer 108 into the frequency domain with the help of a time-frequency transformation. A DFT or an MDCT can be used. The transformation length can be adaptive and for low delay low overlap regions with the previous and next transform windows (cp. 24) will be used. In the rest of the document we will use an MDCT as an illustrative example.

The transformed signal 112 is then shaped in frequency domain by module 204, which is thus implemented for example using scale factor determiner 116 and spectral shaper 110. It can be done by the frequency response of LPC coefficients and by scale factors driven by a psychoacoustic model. It is also possible to apply a time noise shaping (TNS) or a frequency domain prediction exploiting and transmitting a pitch information. In such a case, the pitch information can be conveyed to the context-based arithmetic coder module in view of the pitch-based context mapping. The latter possibility may also be applied to the above embodiments of FIGS. 10*a* to 12*b*, respectively.

The output spectral coefficients are then quantized by quantization stage 120 before being noiselessly coded by the context-based entropy coder 10. As described above, this last module 10 uses, for example, a pitch estimation of the input signal as information concerning the audio signal's spectrum. Such an information can be inherited from one of the noise shaping/prediction module 200 or 204 which have been performed beforehand either in time domain or in frequency domain. If the information is not available, dedicated pitch estimation may be performed on the input signal such as by a pitch estimation module 206 which then sends the pitch information into the bitstream 30.

Figure 14:
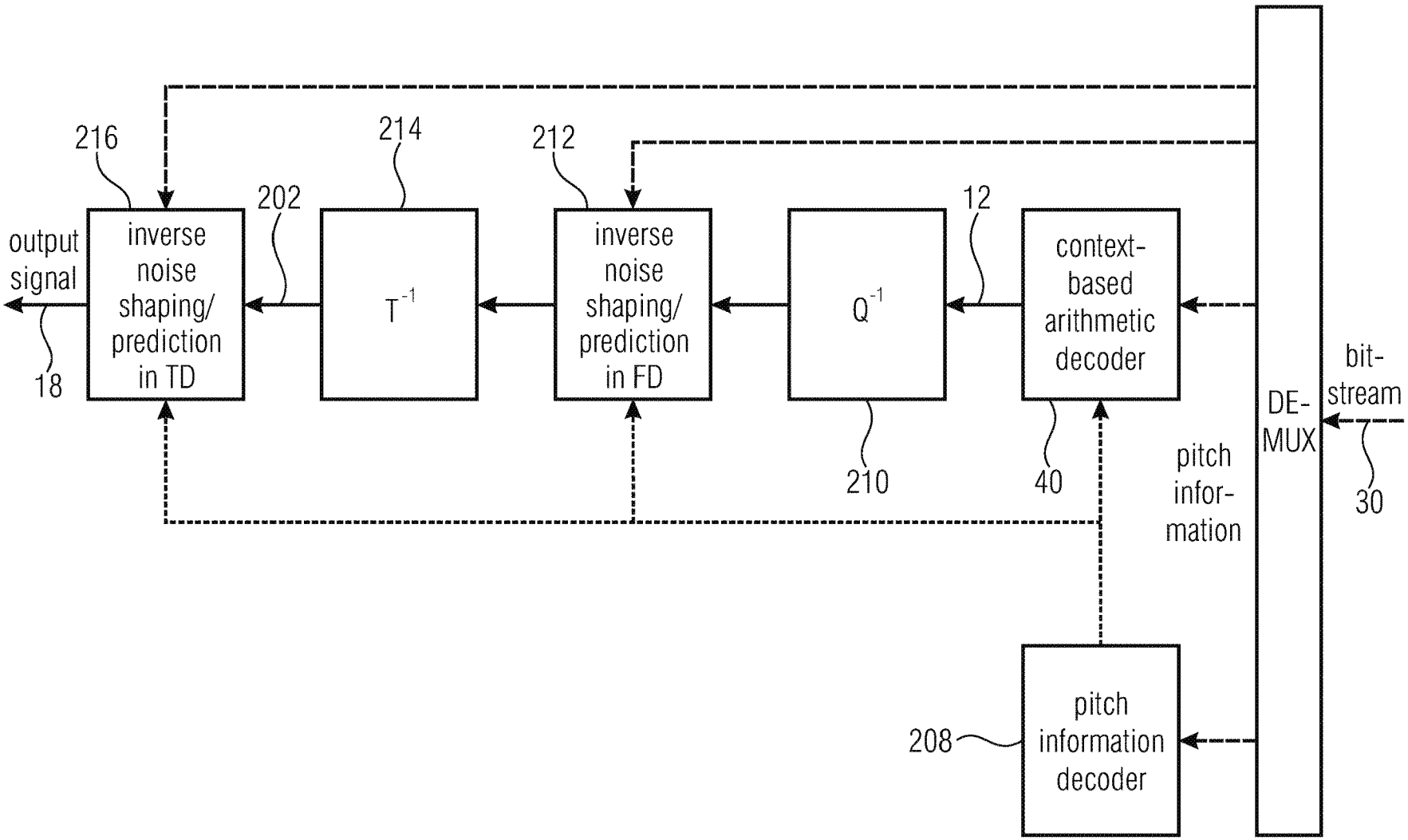
FIG. 14 shows a block diagram of a transform-based audio decoder fitting to the embodiment of FIG. 13.

FIG. 14 shows a general block diagram of the decoding process fitting to FIG. 13. It consists of the inverse processings described in FIG. 13. The pitch information—which is used in the case of FIGS. 13 and 14 as an example of the information on the spectrum's shape—is first decoded and conveyed to the arithmetic decoder 40. If needed, the information is further conveyed to the others modules necessitating this information.

In particular, in addition to the pitch information decoder 208 which decodes the pitch information from the data stream 30 and is thus responsible for the derivation process 84 in FIG. 9*b*, the decoder of FIG. 14 comprises, subsequent to context-based decoder 40, and in the order of their mentioning, a dequantizer 210, an inverse noise shaping/prediction in FD (frequency domain) module 212, an inverse transformer 214 and an inverse noise shaping/prediction in TD module 216, all of which are serially connected to each other so as to reconstruct from the spectrum 12 the spectral coefficients of which are decoded by decoder 40 from bitstream 30, the audio signal 18 in time-domain. In mapping the elements of FIG. 14 onto those shown, for example, in FIG. 12*b*, inverse transformer 214 encompasses inverse transformer 126 and overlap-add stage 144 of FIG. 12*b*. Additionally, FIG. 14 illustrates that dequantization may be applied onto the decoded spectral coefficients output by encoder 40 using, for example, a quantization step function equal for all spectral lines. Further, FIG. 14 illustrates that module 212, such as a TNS (temporal noise shaping) module, may be positioned between spectral shaper 124 and 126. The inverse noise shaping/prediction in time domain module 216 encompasses elements 146 and/or 148 of FIG. 12*b*.

Figure 15:
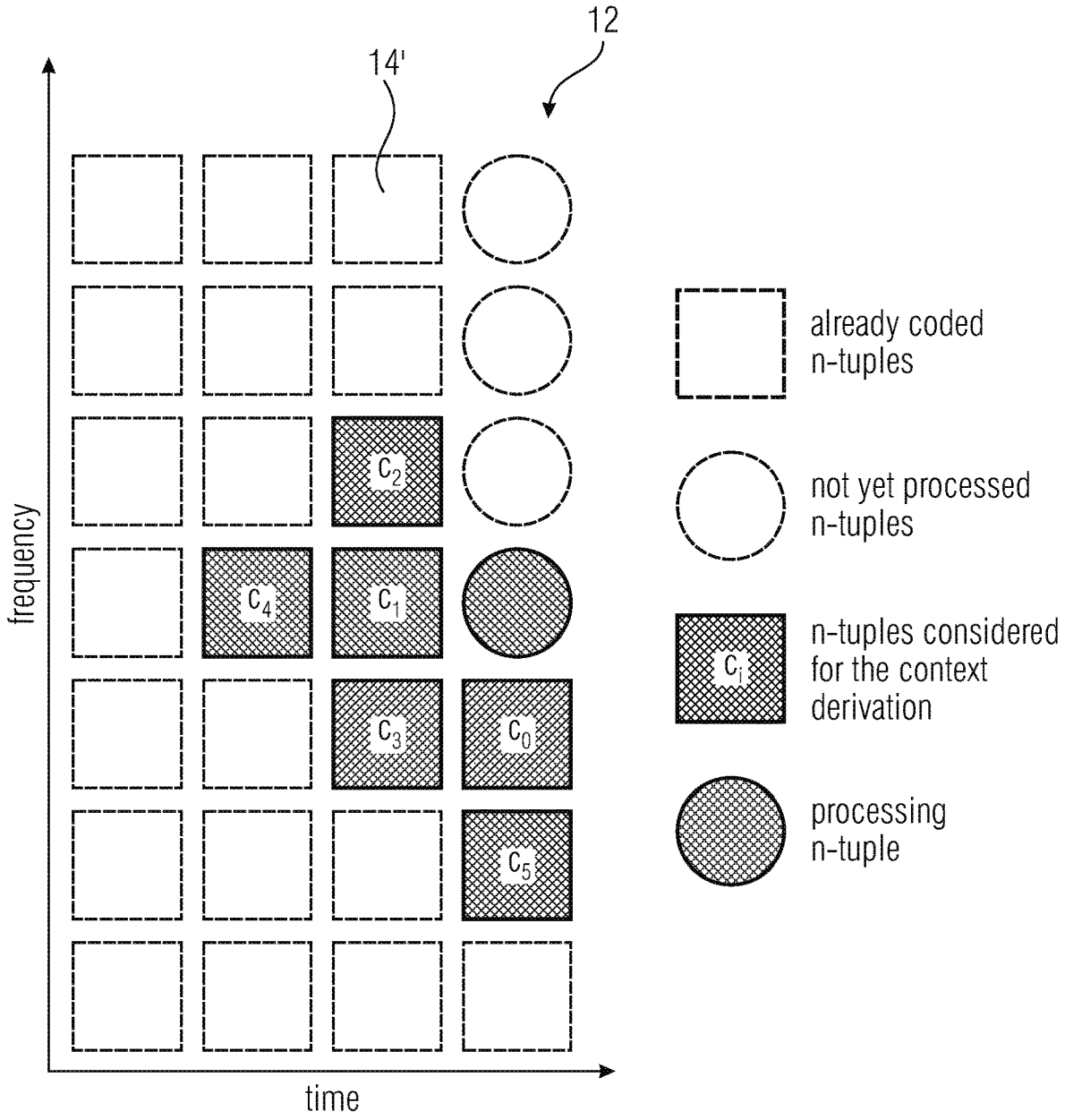
FIG. 15 shows a schematic diagram illustrating a conventional context or context template covering the neighborhood of a currently to be coded/decoded spectral coefficient.

In order to motivate the advantages provided by embodiments of the present application again, FIG. 15 shows a conventional context for entropy coding of spectral coefficients. The context covers a limit area of the past neighborhood of the present coefficients to code. That is, FIG. 15 shows an example for entropy coding spectral coefficients using context-adaptation as it is, for example, used in MPEG USAC. FIG. 15 thus illustrates the spectral coefficients in a manner similar to FIGS. 1 and 2, however with grouping spectral neighboring spectral coefficients, or partitioning them, into clusters, called n-tuples of spectral coefficients. In order to distinguish such n-tuples from the individual spectral coefficients, while nevertheless keeping consistency with the description brought forward above, these n-tuples are indicated using reference sign 14'. FIG. 15 distinguishes between already encoded/decoded n-tuples on the one hand and not yet coded/decoded n-tuples by depicting the form of ones using rectangular outlines, and the latter ones using circular outlines. Further, the n-tuple 14' currently to be decoded/coded is depicted using hatching and a circular outline, while the already coded/decoded n-tuples 14' localized by a fixed neighborhood template positioned at the currently to be processed n-tuple are also indicated using hatching, however having a rectangular outline. Thus, in accordance with the example of FIG. 15, the neighborhood context template identified six n-tuples 14' in the neighborhood of the currently to be processed n-tuple, namely the n-tuple at the same time instant but at immediately neighboring, lower spectral line(s), namely $c_0$, one at the same spectral line(s), but at an immediately preceding time instant, namely $c_1$, the n-tuple at the immediate neighboring, higher spectral line at the immediate preceding time instant, namely $c_2$ and so forth. That is, the context template used in accordance with FIG. 15 identifies reference n-tuples 14' at fixed relative distances to the currently to be processed n-tuple, namely the immediate neighbors. In accordance with FIG. 15, the spectral coefficients are exemplarily considered in blocks of n, called n-tuples. Combining n consecutive values permits to exploit the inter-coefficient dependencies. Higher dimensions increase exponentially the alphabet size of n-tuple to code and therefore the codebook size. A dimension of n=2 is exemplarily used the rest of the description and represents a compromise between coding gain and codebook size. In all embodiments, the coding considers, for example, separately the sign. Moreover, the 2 most significant bits and the remaining least significant bits of each coefficient may be treated separately, too. The context adaptation may be applied, for example, only to the 2 most significant bits (MSBs) of the unsigned spectral values. The sign and the least significant bits may be assumed to be uniformly distributed. Along with the 16 combinations of the MSBs of a 2-tuple, an escape symbol, ESC, is added in the alphabet for indicating that one additional LSB has to be expected by the decoder. As many ESC symbols as additional LSBs are transmitted. In total, 17 symbols form the alphabet of the code. The present invention is not limited to the above described way of generating the symbols.

Transferring the latter specific details onto the description of FIGS. 3 and 4, this means the following: the symbol alphabet of the entropy encoding/decoding engine 44 and 54 may encompass the values {0, 1, 2, 3} plus an escape symbol, and the inbound spectral coefficient to be encoded is divided by 4 if it exceeds 3 as often as necessitated in order to be smaller than 4 with encoding an escape symbol per division. Thus, 0 or more escape symbols followed by the actual non-escape symbol are encoded for each spectral coefficient, with merely the first two of these symbols, for example, being coded using the context-adaptivity as described herein before. Transferring this idea to 2-tuplesi. i.e. pairs of immediate spectrally neighboring coefficients, the symbol alphabet may comprise 16 values pairs for this 2-tuple, namely {(0, 0), (0, 1), (1, 0), . . . , (1, 1)}, and the secape symol esc (with esc being an abbreviation for the escape symbol), i.e. altogether 17 symbols. Every inbound spectral coefficient n-tuple comprising at least one coefficient exceeding 3 is subject to division by 4 applied to each coefficient of the respective 2-tuple. At the decoding side, the number of escape symbols times 4, if any, is added to the remainder value obtained from the non-escape symbol.

FIG. 16 shows the configuration of a mapped context mapping resulting from modifying the concept of FIG. 15 according to the concept outlined above according to which the relative spectral distance 28 of reference spectral coefficients is adapted dependent on information on the spectrum's shape such as, for example, by taking into account the periodicity or pitch information of the signal. In particular, FIGS. 16*a* to 16*c* show that the distance D, which corresponds to the aforementioned relative spectral distance 28, within the context can be roughly estimated by D0 given by the following formula:

$$D0 = \frac{f_s}{L} \times \frac{2N}{f_s}$$

here, $f_s$ is the sampling frequency, N the MDCT size and L the lag period in samples. In example FIG. 16(*a*), the context points to the n-tuples distant to the current n-tuple to code by a multiple of D. FIG. 16(*b*) combines the conventional neighborhood context with a harmonic related context. Finally FIG. 16(*c*) shows an example of an intra-frame mapped context with no dependencies with previous frames. That is, FIG. 16*a* illustrates that, in addition to the possibilities set out above with respect to FIG. 7, the adaptation of the relative spectral distance depending on the information on the spectrum's shape may be applied to all of a fixed number of reference spectral coefficients belonging to the context template. FIG. 16*b* shows that, in accordance with a different example, merely a subset of these reference spectral coefficients is subject to displacement in accordance with adaptivity 80, such as, for example, merely the spectrally outermost ones at the low-frequency side of the context template, here $C_3$ and $C_5$. The remaining reference spectral coefficients, here $C_0$ to $C_4$, may be positioned at fixed positions relative to the currently processed spectral coefficient, namely at immediately adjacent spectrotemporal positions relative to the currently to be processed spectral coefficient. Finally, FIG. 16*c* shows the possibility that merely previously coded spectral coefficients are used as reference coefficients of the context template, which are positioned at the same time instant as the currently to be processed spectral coefficient.

Figure 17:
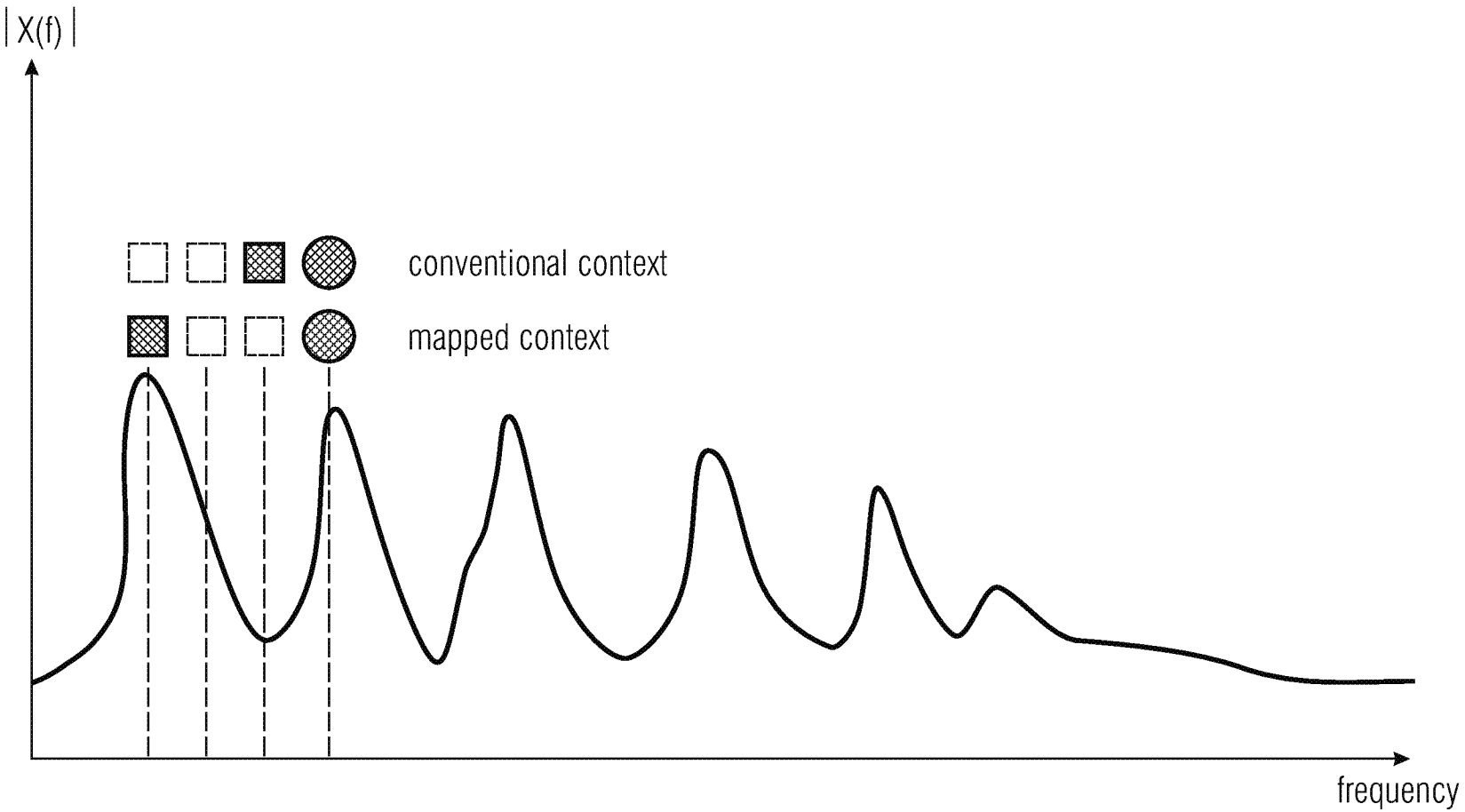
FIG. 17 schematically illustrates a graph of a harmonic spectrum so as to illustrate the advantage of using the mapped context of any of FIGS. 16*a* to 16*c* over the context template definition of FIG. 15 for a harmonic spectrum.

FIG. 17 gives an illustration how the mapped context of FIGS. 16*a-c* can be more efficient than the conventional context according to FIG. 15 which fails to predict a tone of a highly harmonic spectrum X (cp. 20).

Subsequently, we will describe in detail a possible context mapping mechanism and present exemplary implementations for efficiently estimating and coding the distance D. For illustrative purposes, we will use in the following sections an intra-frame mapped context according to FIG. 16*c*.

First Embodiment: 2-Tuple Coding and Mapping

First the optimal distance is search in a way to reduce at most the number of bits needed to code the current quantized spectrum x[ ] of size N. An initial distance can be estimated by D0 function of the lag period L found in previously performed pitch estimation. The search range can be as follows:

$$D0-\Delta<D<D0+\Delta$$

Figure 18:
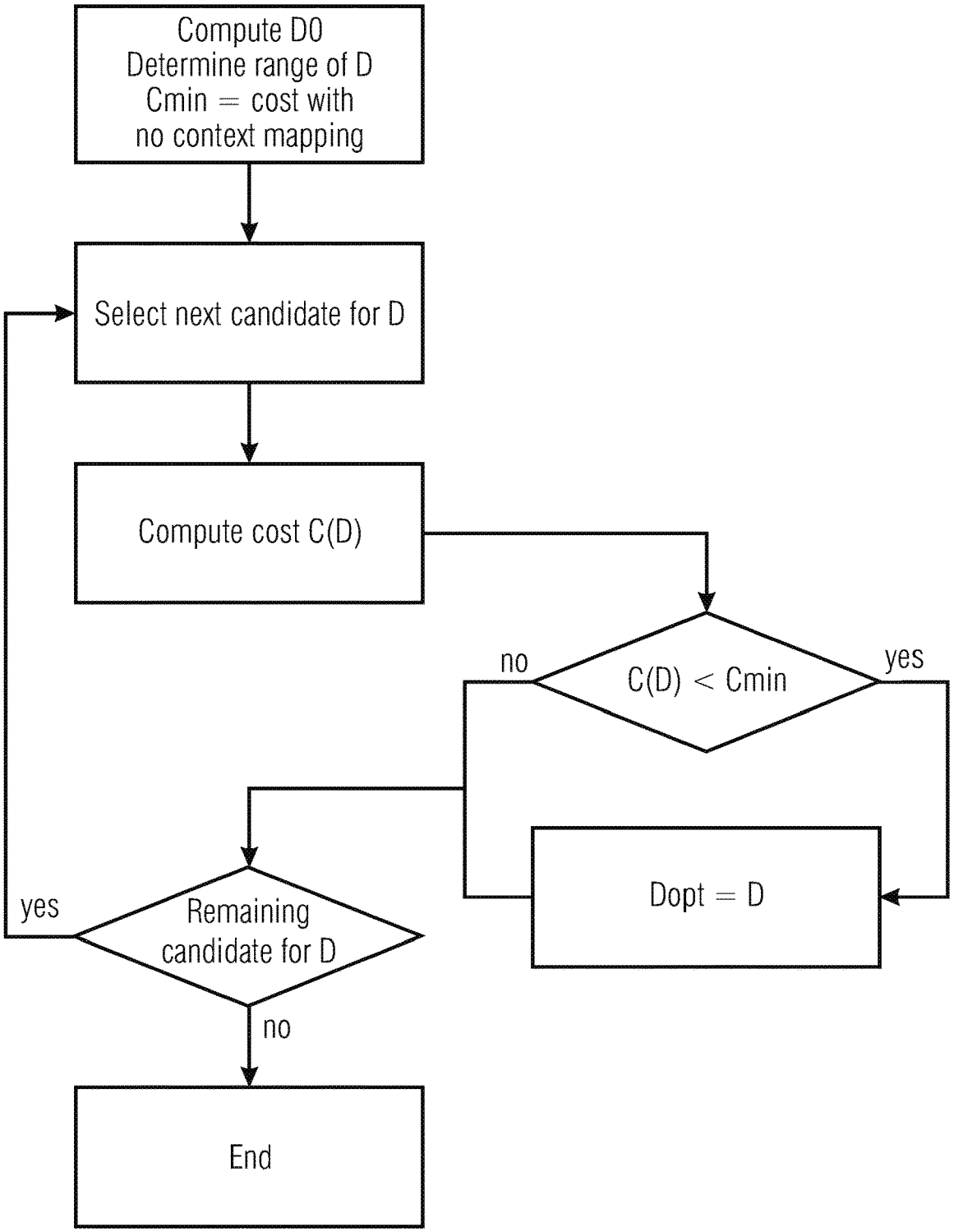
FIG. 18 shows a flow diagram of an algorithm for optimizing the relative spectral distance D for the context mapping in accordance with an embodiment.

Alternatively, the range can be amended by considering a multiple of D0. The extended range becomes:

$$\{M\cdot D0-\Delta<D<M\cdot D0+\Delta:\ M\in F\}$$

where M is a multiplicative coefficient belonging to a finite set F. For example. M can get the values 0.5, 1 and 2, for exploring the half and the double pitch. Finally one can also make an exhaustive search of D. In practice, this last approach may be too complex. FIG. 18 gives an example of a search algorithm. This search algorithm may, for example, be part of the derivation process 82 or both derivation processes 82 and 84 at decoding and encoding side.

The cost is initialized to the cost when no mapping for the context is performed. If no distance leads to a better cost, no mapping is performed. A flag is transmitted to the decoder for signaling when the mapping is performed.

If an optimal distance Dopt is found, one needs to transmit it. If L was already transmitted by another module of the encoder, adjustment parameters m and d, corresponding to the aforementioned explicit signaling of FIG. 9*b*, are needed to be transmitted in a way that $$Dopt=m\cdot D0+d$$

Otherwise, the absolute value of Dopt has to be transmitted. Both alternatives were discussed above with respect to FIG. 9*b*. For example if we considered an MDCT of size N=256 and fs=12800 Hz, we can cover a pitch frequency between 30 Hz and 256 Hz by limiting D between 2 and 17. With an integer resolution, D can be coded with 4 bits, with 5 bits for a resolution of 0.5 and with 6 bits with 0.25.

The cost function can be calculated as the number of bits needed to code x[ ] with D used for generating the context mapping. This cost function is usually complex to obtain as it necessitates to code arithmetically the spectrum or at least to have a good estimate of the number of bits it needs. As this cost function can be complex to compute for each candidate D. we propose as an alternative to get an estimate of the cost directly from the derivation of the context mapping from the value D. While deriving the context mapping, one can easily compute the difference of the norm of the adjacent mapped context. Since the context is used in the arithmetic coder to predict the n-tuple to code and since the context is computed in our embodiment based on the norm-L1, the sum of the difference of norm between adjacent mapped contexts is a good indication of the efficiency of the mapping given D. First the norm of each 2-tuple of x[ ] is computed as follows:

```
for(i=0;i<N/2;i++){
    normVect[i]= pow(abs(x[2*i]NORM,)+ pow(abs(normVect[2*i+1],
    NORM),
}
```

Where NORM=1 in the embodiment as we consider the norm-L1 in the context computation. In this section we are describing a context mapping which works with a resolution of 2, i.e. one mapping per 2-tuple. The resolution is r=2 and the context mapping table has a size of N/2. The pseudo code of context mapping generation and the cost function computation is given below:

```
Input: resolution r
Input: normVect[N/r]
Output: contextMapping[N/r]
m=1;
  i = (int)( m*D/r));
k = 0;
meanDiffNorm= oldNorm=0;
/*Detect Harmonics of spectrum*/
while (i <=N/r-preroll) {
    for(o=0;o<preroll;o++){
        meanDiffNorm += abs(normVect[i]-oldNorm);
        oldNorm=normVect[i];
            IndexPermutation[k++] = i;
            i++;
        }
        m+=1;
        i = (int)((m * D)/r));
    }
/*Detect valleys od spectrum */
    SlideIndex=k;
    i = 0;
    for (o = 0; o < k; o+=preroll) {
        for (; i < IndexPermutation[o]; i++) {
                meanDiffNorm += abs(normVect[i]-oldNorm);
                oldNorm=normVect[i];
                IndexPermutation[SlideIndex++] = i;
        }
```

-continued

```
            /*skip tonal component*/
            i+=preroll; }
/*Detect tail of spectrum*/
    for (i = SlideIndex; i < numVect; ++i) {
            meanDiffNorm +=abs(normVect[i]-oldNorm);
                oldNorm=normVect[i];
            IndexPermutation[i] = i;
}
```

Once the optimal distance D is computed, the index permutation table is also deduced, which gives the harmonics positions, the valleys and the tail of the spectrum. The context mapping rules is then deduced as:

```
for (i = 0; i < N/r; i++) {
    contextMapping[IndexPermutation[i]]=i;
}
```

That means that for a 2-tuple of index i in the spectrum (x[2*i],x[2*i+1]), the past context will be considered with 2-tuples of indexes contextMapping[i−1], contextMapping [i−2] . . . contextMapping[i−I], where I is the size of the context in terms of 2-tuples. If one or more previous spectra are also considered for the context, the 2-tuples for these spectra incorporated in the past context will have as indexes contextMapping[i+I], . . . , contextMapping[i+1], contextMapping[i], contextMapping[i−1], contextMapping[i−I], where 2I+1 is the size of the context per previous spectrum.

The IndexPermutation table gives also additional interesting information as it gathers the indexes of the tonal components following by the indexes of the non-tonal components. Therefore we can expect that the corresponding amplitudes are decreasing. It can be exploited by detecting the last index in IndexPermutaion, which corresponds to non-zero 2-tuple. This index corresponds to (lastNz/2−1), where lastNz is computed as:

```
for ( lastNz = (N−2) ; lastNz >= 0 ; lastNz −= 2)
{
    if( ( x[2*IndexPermutaion[lastNz/2]] != 0) || ( x[2* IndexPermutaion[lastNz/2]+1] != 0))
        break;
}
lastNz += 2;
```

lastNz/2 is coded on ceil(log 2(N/2)) bits before the spectral components.

Arithmetic encoder pseudo-code:

```
Input: spectrum x[N]
Input: contextMapping[N/2]
Input: lastNz
Output: coded bitstream
    for (i = 0; i < N/2;i++)
    {
        while((i<N/2) && (contextMapping [i]>=lastNz/2)){
            context[contextMapping[i]] = −1;
            i++;
        }
        if(i>=N/2){
            break;
        }
        a=a1 = abs(x[2*i]);
        b=b1 = abs(x[2*i+1]);
            t = (context[contextMapping [i−2]<<6) + context[contextMapping [i−1];
            while ( (a1 >= 4 ) || ( b1 >= 4 ) )
```

-continued

```
            {
                /*encode escape symbol*/
                pki = proba__model__lookup[t];
                ari__encode(cum__proba[pki], 16,17);
                (a1) >>= 1;
                (b1) >>= 1;
            /*encode LSBs*/
            ari__encode(cum__equiproba,a1&1,2);
            ari__encode(cum__equiproba,b1&1,2);
                }
                /*encode MSBs*/
                pki = proba__model__lookup[t];
                ari__encode(cum__proba[pki], a1 + 4*b1,17);
                /*encode signs*/
                If(a>0)
    {
                        ari__encode(cum__equiproba,x[2*i]>0,2);
    }
    If(b>0)
    {
                    ari__encode(cum__equiproba,x[2*i+1 ]>0,2);
    }
    /*Update context*/
    context[contextMapping [i]]=min(a+b,power(2,6));
```

The cum_proba[ ] tables are different cumulative models obtained during an offline training on a large training set. It comprises in this specific case 17 symbols. The proba_model_lookup[ ] is a lookup table mapping a context index t to a cumulative probability model pki. This table is also obtained through a training phase. cum_equiprob[ ] is a cumulative probability table for an alphabet of 2 symbols which are equi-probable.

Second Embodiment: 2-Tuple with 1-Tuple Mapping

In this second embodiment, the spectral components are still coded 2-tuples by 2-tuples but the contextMapping has now a resolution of 1-tuple. That means that there are much more possibilities and flexibilities in mapping the context. The mapped context can be then better suited to a given signal. The optimal distance is searched the same way as it is done in section 3 but this time with a resolution r=1. For that, normVect[ ] has to be computed for each MDCT line:

```
            for(i=0;i<N;i++){
                normVect[i]= pow(abs(x[2*i]NORM,);
            }
```

The resulting context mapping is then given by a table of dimension N. LastNz is computed as in previous section and the encoding can be described as follows:

```
Input: lastNz
Input: contextMapping[N]
Input: spectrum x[N]
output: coded bitstream
local: context[N/2]
for ( k=0,i = 0; k< lastnz ; k+=2){
    /* Next coefficient to code*/
    while(contextMapping[i]>=lastnz) i++;
    a1__i=i++;
    /* Next coefficient to code*/
    while(contextMapping[i]>=lastnz) i++;
    b1__i=i++;
    /*Get context for the lowest index*/
    i__min=min(contextMapping[a1__i], contextMapping[b1__i]);
```

-continued

```
    t = context[(i__min/2)−2]<<6 + context[(i__min/2)−1];
    /* Init current 2-tuple encoding */
    a=a1 = abs(x[a1__i]);
    b=b1 = abs(x[b1__i]);
    while ( ( a1 >=4 ) || ( b1 >=4 ) )
    {
        /*encode escape symbol*/
        pki = proba__model__lookup[t];
        ari__encode(cum__proba[pki], 16, 16);
        (a1) >>= 1;
        (b1) >>= 1;
        /*encode LSBs*/
        ari__encode(cum__equiproba,a1&1,2);
        ari__encode(cum__equiproba,b1&1,2);
    }
    /*encode MSBs*/
    pki = proba__model__lookup[t];
    ari__encode(cum__proba[pki], a1 +4*b1,16);
    /*encode signs*/
    if(a>0) ari__encode(cum__equiproba,x[2*i]>0,2);
    if(b>0) ari__encode(cum__equiproba,x[2*i+1]>0,2);
    /*update context*/
    if(contextMapping[a1__i]!=( contextMapping [b1__i]−1)){
        context[contextMapping[a1__i]/2]=min(a+a,power(2,6));
        context[contextMapping[b1__i]/2]=min(b+b,power(2,6));
    }else{
        context[contextMapping[a1__i]/2]=min(a+b,power(2,6));
            context[contextMapping[b1__i]/2]=min(a+b,power(2,6));
    }
}
```

Contrary to the previous section, two non-subsequent spectral coefficients can be gather in the same 2-tuple. For this reason, the context mapping for the two elements of the 2-tuple can point to two different indexes in the context table. In the embodiment, we select the mapped context with the lowest index but one can also have a different rule, like averaging the two mapped contexts. For the same reason the update of the context should also be handled differently. If the 2 elements are consecutive in the spectrum, we use the conventional way of computing the context. Otherwise, the context is updated separately for the 2 elements considering only its own magnitude.

The decoding consists of the following steps:

Decode the flag to know if context mapping is performed

Decode the context mapping, by decoding either Dopt or the parameter adjustment parameters for getting Dopt for D0.

Decode lastNz

Decode the quantized spectrum as follows:

```
Input: lastNz
Input: contextMapping[N]
Input: coded bitstream
local: context[N/2]
Output: quantized spectrum x[N]
for (k=0,i = 0 ; k < lastnz ; k+=2){
    a=b=0;
    /* Next coefficient to code*/
    while(contextMapping[i]>=lastnz) x[ i++]=0;
    a1__i=i++;
    /* Next coefficient to code*/
    while(contextMapping[i]>=lastnz) x[ i++]=0;
    b1__i=i++;
    /*Get context for the lowest index*/
    i__min=min(contextMapping[a1__i], contextMapping[b1__i]);
    t = context[(i__min/2)-2]<<6 + context[(i__min/2)-1];
    /* Init current 2-tuple encoding */
    a=a1 = abs(x[a1__i]);
    b=b1 = abs(x[b1__i]);
/*MSBs decoding*/
for (lev=0;;)
{
    pki = proba__model__lookup[t];
    r= ari__decode(cum__proba[pki], 16);
        if(r<16){
                break;
            }
            /*LSBs decoding*/
            a=(a)+ ari__decode(cum__equiproba,2)<<(lev));
            b=(b)+ ari__decode(cum__equiproba,2) <<(lev));
        lev+=1;
        }
    b1= r>>2;
    a1= r&0x3;
    a += (a1)<<lev;
    b += (b1)<<lev;
    /*update context*/
    if(contextMapping[a1__i]!=( contextMapping [b1__i]-1)){
        context[contextMapping[a1__i]/2]=min(a+a,power(2,6));
        context[contextMapping[b1__i]/2]=min(b+b,power(2,6));
    }else{
        context[contextMapping[a1__i]/2]=min(a+b,power(2,6));
            context[contextMapping[b1__i]/2]=min(a+b,power(2,6));
    }
    /*decode signs*/
    if(a>0) a=a*(-2*ari__decode(cum__equiproba ,2)+1);
    if(b>0) b=b*(-2*ari__decode(cum__equiproba ,2)+1);
    /* Store decoded data */
        x[a1__i] = a;
        x[b1__i] = b;
}
```

Thus, above embodiments, inter alias, revealed a, for example, pitch-based context mapping for entropy, such as arithmetic, coding of tonal signals.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Fuchs, G.; Subbaraman, V.; Multrus, M., "Efficient context adaptive entropy coding for real-time applications," Acoustics, Speech and Signal Processing (ICASSP), 2011 IEEE International Conference on, vol., no., pp. 493,496, 22-27 May 2011

[2] ISO/IEC 13818, Part 7, MPEG-2 AAC

[3] Juin-Hwey Chen; Dongmei Wang, "Transform predictive coding of wideband speech signals," Acoustics, Speech, and Signal Processing, 1996. ICASSP-96. Conference Proceedings., 1996 IEEE International Conference on, vol. 1, no., pp. 275,278 vol. 1, 7-10 May 1996

The invention claimed is:

1. Decoder for decoding spectral coefficients of a spectrogram of an audio signal from a data stream, composed of a sequence of a spectra, the decoder being configured to decode the spectral coefficients along a spectrotemporal path which scans the spectral coefficients spectrally within one spectrum and then proceeds with spectral coefficients of a temporally succeeding spectrum, decode, by context-adaptive entropy decoding, a currently to be decoded spectral coefficient of a current spectrum depending on a template of previously decoded spectral coefficients including a spectral coefficient belonging to the current spectrum, the template being positioned at a location of the currently to be decoded spectral coefficient, by adjusting a relative spectral distance between the spectral coefficient belonging to the current spectrum and the currently to be decoded spectral coefficient depending on an information concerning a shape of the spectrum.

2. Decoder according to claim 1, wherein the information concerning the shape of the spectrum is a measure of a pitch of the audio signal and the decoder is configured to adjust the relative spectral distance depending on the measure of the pitch such that the relative spectral distance increases with increasing pitch, or the information concerning the shape of the spectrum is a measure of a periodicity of the audio signal and the decoder is configured to adjust the relative spectral distance depending on the measure of periodicity such that the relative spectral distance decreases with increasing periodicity, or the information concerning the shape of the spectrum is a measure of an inter-harmonic distance of the audio signal's spectrum, and the decoder is configured to adjust the relative spectral distance depending on the measure of the inter-harmonic distance such that the relative spectral distance increases with increasing inter-harmonic distance, or the information concerning the shape of the spectrum comprises relative locations of formants and/or valleys of a spectral envelope of the spectrum, and the decoder is configured to adjust the relative spectral distance depending on the location such that the relative spectral distance increases with increasing spectral distance between the valleys in the spectral envelope and/or between the formants in the spectral envelope.

3. Decoder for decoding spectral coefficients of a spectrogram of an audio signal from a data stream, composed of a sequence of a spectra, the decoder being configured to decode the spectral coefficients along a spectrotemporal path which scans the spectral coefficients spectrally within one spectrum and then proceeds with spectral coefficients of a temporally succeeding spectrum, decode, by context-adaptive entropy decoding, a currently to be decoded spectral coefficient of a current spectrum depending on a template of previously decoded spectral coefficients including first and second spectral coefficients belonging to the current spectrum, the template being positioned at a location of the currently to be decoded spectral coefficient, by adjusting a relative spectral distance between the first and second spectral coefficients depending on an information concerning a shape of the spectrum.

4. Decoder according to claim 3, wherein the information concerning the shape of the spectrum is a measure of a pitch of the audio signal and the decoder is configured to adjust the relative spectral distance depending on the measure of the pitch such that the relative spectral distance increases with increasing pitch, or the information concerning the shape of the spectrum is a measure of a periodicity of the audio signal and the decoder is configured to adjust the relative spectral distance depending on the measure of periodicity such that the relative spectral distance decreases with increasing periodicity, or the information concerning the shape of the spectrum is a measure of an inter-harmonic distance of the audio signal's spectrum, and the decoder is configured to adjust the relative spectral distance depending on the measure of the inter-harmonic distance such that the relative spectral distance increases with increasing inter-harmonic distance, or the information concerning the shape of the spectrum comprises relative locations of formants and/or valleys of a spectral envelope of the spectrum, and the decoder is configured to adjust the relative spectral distance depending on the location such that the relative spectral distance increases with increasing spectral distance between the valleys in the spectral envelope and/or between the formants in the spectral envelope.

5. Decoder according to claim 1, wherein the decoder is configured to derive the information concerning the shape of the spectrum from explicit signalization.

6. Decoder according to claim 1, wherein the decoder is configured to, in decoding the currently to be decoded spectral coefficient by entropy decoding, derive a probability distribution estimation for the currently to be decoded spectral coefficient by subjecting the previously decoded spectral coefficients of the template to a scalar function and use the probability distribution estimation for the entropy decoding.

7. Decoder according to claim 1, wherein the decoder is configured to decode the currently to be decoded spectral coefficient by spectrally and/or temporally predicting the currently to be decoded spectral coefficient and correcting the spectral and/or temporal prediction by a prediction residual obtained via the entropy decoding.

8. Transform-based audio decoder comprising a decoder configured to decode spectral coefficients of a spectrogram of an audio signal according to claim 1.

9. Transform-based audio decoder according to claim 8, wherein the decoder is configured to spectrally shape the spectra by scaling the spectra using scale factors.

10. Transform-based audio decoder according to claim 9, configured to determine the scale factors based on linear prediction coefficient information so that the scale factors represent a transfer function depending on a linear prediction synthesis filter defined by the linear prediction coefficient information.

11. Transform-based audio decoder according to claim 10, wherein the transfer function's dependency on the linear prediction synthesis filter defined by the linear prediction coefficient information is such that the transfer function is perceptually weighted.

12. Transform-based audio decoder according to claim 11, wherein the transfer function's dependency on the linear prediction synthesis filter, 1/A(z), defined by the linear prediction information, is such that the transfer function is a transfer function of $1/A(k \cdot z)$, where k is a constant.

13. Transform-based audio decoder according to claim 10, wherein the transform-based audio decoder supports long term prediction harmonic or post filtering controlled via explicitly signaled long term prediction parameters, wherein the transform-based audio decoder is configured to derive the information concerning the shape of the spectra from the explicitly signaled long term prediction parameters.

14. Encoder for encoding spectral coefficients of a spectrogram of an audio signal into a data stream, composed of a sequence of a spectra, the encoder being configured to encode the spectral coefficients along a spectrotemporal path which scans the spectral coefficients spectrally within one spectrum and then proceeds with spectral coefficients of a temporally succeeding spectrum, encode, by context-adaptive entropy encoding, a currently to be encoded spectral coefficient of a current spectrum depending on a template of previously encoded spectral coefficients including a spectral coefficient belonging to the current spectrum, the template being positioned at a location of the currently to be encoded spectral coefficient, by adjusting a relative spectral distance between the spectral coefficient belonging to the current spectrum and the currently to be encoded spectral coefficient depending on an information concerning a shape of the spectrum.

15. Encoder for encoding spectral coefficients of a spectrogram of an audio signal into a data stream, composed of a sequence of a spectra, the encoder being configured to encode the spectral coefficients along a spectrotemporal path which scans the spectral coefficients spectrally within one spectrum and then proceeds with spectral coefficients of a temporally succeeding spectrum, encode, by context-adaptive entropy encoding, a currently to be encoded spectral coefficient of a current spectrum depending on a template of previously encoded spectral coefficients including first and second spectral coefficients belonging to the current spectrum, the template being positioned at a location of the currently to be encoded spectral coefficient, by adjusting a relative spectral distance between the first and second spectral coefficients depending on an information concerning a shape of the spectrum.

16. Method for decoding spectral coefficients of a spectrogram of an audio signal into a data stream, composed of a sequence of a spectra, the method comprising decoding the spectral coefficients along a spectrotemporal path which scans the spectral coefficients spectrally within one spectrum and then proceeds with spectral coefficients of a temporally succeeding spectrum, decoding, by context-adaptive entropy decoding, a currently to be decoded spectral coefficient of a current spectrum depending on a template of previously decoded spectral coefficients including a spectral coefficient belonging to the current spectrum, the template being positioned at a location of the currently to be decoded spectral coefficient, by adjusting a relative spectral distance between the spectral coefficient belonging to the current spectrum and the currently to be decoded spectral coefficient depending on an information concerning a shape of the spectrum.

17. Method for encoding spectral coefficients of a spectrogram of an audio signal into a data stream, composed of a sequence of a spectra, the method comprising encoding the spectral coefficients along a spectrotemporal path which scans the spectral coefficients spectrally within one spectrum and then proceeds with spectral coefficients of a temporally succeeding spectrum, encoding, by context-adaptive entropy encoding, a currently to be encoded spectral coefficient of a current spectrum depending on a template of previously encoded spectral coefficients including a spectral coefficient belonging to the current spectrum, the template being positioned at a location of the currently to be encoded spectral coefficient, by adjusting a relative spectral distance between the spectral coefficient belonging to the current spectrum and the currently to be encoded spectral coefficient depending on an information concerning a shape of the spectrum.

18. Non-transitory computer-readable storage medium storing a computer program having a program code for performing, when running on a computer, a method according to claim 16.

19. Non-transitory computer-readable storage medium storing a computer program having a program code for performing, when running on a computer, a method according to claim 17.

* * * * *